US006062312A

United States Patent [19]

Wilkins

[11] Patent Number: 6,062,312

[45] Date of Patent: May 16, 2000

[54] TREE RUNNING TOOL WITH EMERGENCY RELEASE

[75] Inventor: Robert Lee Wilkins, Houston, Tex.

[73] Assignee: Kvaerner Oilfield Products, Houston, Tex.

[21] Appl. No.: 09/057,743

[22] Filed: Apr. 9, 1998

[51] Int. Cl.[7] ..... E21B 33/038

[52] U.S. Cl. ..... 166/340; 166/360; 166/365

[58] Field of Search ..... 166/339, 340, 166/341, 344, 360, 363, 365, 368

[56] References Cited

U.S. PATENT DOCUMENTS

| | | | |
|---|---|---|---|
| 3,739,846 | 6/1973 | Beson | 166/89 |
| 3,965,977 | 6/1976 | Beson | 166/88 |
| 4,703,774 | 11/1987 | Seehausen | 137/614 |
| 4,709,725 | 12/1987 | Morrison | 137/614 |
| 4,796,922 | 1/1989 | Prichard | 285/26 |
| 4,852,611 | 8/1989 | Knerr et al. | 137/595 |
| 4,867,605 | 9/1989 | Myers et al. | 166/341 |
| 4,902,044 | 2/1990 | Williams et al. | 166/340 |
| 5,005,650 | 4/1991 | Hopper | 166/339 |
| 5,213,162 | 5/1993 | Iato | 166/365 |
| 5,782,304 | 7/1998 | Garcia-Soule et al. | 166/363 |
| 5,794,701 | 8/1998 | Cunningham et al. | 166/344 |

FOREIGN PATENT DOCUMENTS

| | | |
|---|---|---|
| 2097885 | of 0000 | United Kingdom . |
| 2132728 | of 0000 | United Kingdom . |
| 2184508 | of 0000 | United Kingdom . |
| 2195158 | of 0000 | United Kingdom . |

*Primary Examiner*—William Neuder
*Attorney, Agent, or Firm*—Wendy K. Buskop; Bayko Gibson et al.

[57] ABSTRACT

In accordance with certain preferred aspects of the present invention, there is provided tree running tool with a mechanical mechanism for unlatching the tree running tool from a side valve tree. The tree running tool is formed from a tool body, a stem, a telescoping element, a retractable spacer, a means for moving the spacer, and a means for attaching the telescoping element to a lift device. The tool body has an upper end, a lower end, and a longitudinal axis. The stem is fixedly attached to the upper end of the tool body and extends axially therefrom. The stem has a lower end attached to the tool body and a generally annular flange at a position spaced apart from the tool body. The telescoping element is positioned alongside the stem. The telescoping element has a generally annular flange at a position between the generally annular flange of the stem and the tool body. The retractable spacer is movable from an engaged position between the generally annular flange of the stem and the generally annular flange of the telescoping element, in which the spacer spaces the generally annular flange of the stem apart from the generally annular flange of the telescoping element, to a retracted position in which a void is formed between the generally annular flange of the stem and the generally annular flange of the sleeve. The means for moving the spacer is mounted to the tool body and the spacer for moving the spacer from the engaged position to the retracted position. The means for attaching the telescoping element to a lift device is mounted to the telescoping element.

14 Claims, 26 Drawing Sheets

TREE RUNNING TOOL WITH EMERGENCY RELEASE

BACKGROUND OF THE INVENTION

This invention relates to various aspects of a tool useful for performing operations involving subsea christmas trees used by the oil and gas industry, and to various methods relating thereto.

Subsea christmas trees typically employ a specialized hydraulic clamping connector (typically called a tree connector) which latches and seals to a vertically oriented subsea wellhead housing which has been pre-installed on the sea bed. Functionally, the tree connector contains well pressure and serves to transmit external loading forces which are imposed on the subsea tree and ultimately the wellhead housing. These external loading forces are typically generated by a workover completion riser (tubulars) system which extends upwards from the subsea Christmas tree to an overhead floating workover completion vessel, typically a semi-submersible drilling rig. Other external forces may be imposed on the subsea tree due to items such as fishing trawls or flowline connection systems.

The connector typically seals to the wellhead housing by means of a metallic gasket which is energized between two mating conically shaped seal surfaces as the connector is latched to the wellhead housing. The connector latching system typically generates a vertical clamping force to the wellhead, typically called pre-load. The pre-load is generally a result of vertically applied force which is magnified by a mechanical advantage in a wedge-type clamping system. This pre-load force can vary in magnitude between designs, but ideally should be equal to or greater than the total combined equivalent tension on the connector. This is the summation of all axial forces generated by gasket compression, pressure end load, external tension, and external bending. The "ideal preload" requirement serves to prevent movement of the connector wellhead seal under load and ensure there is no metallic wellhead gasket damage on seal surfaces due to repetitive movements because of alternating stress cycles due to cyclical loading. Generally, the ideal preload requirement may not be required and may be of a significantly lesser value when cyclical loading is small. This has a direct bearing on the size and cost of a connector.

The subsea christmas tree connectors typically include a wellhead latching mechanism which is actuated by some form of integral hydraulic piston system. These systems vary from a number of discrete hydraulic cylinders to a single large diameter annular piston arrangement. The discrete piston system typically offers low pre-load because of limited piston area, while the large diameter annular piston design offers high pre-load, usually approaching or exceeding "ideal". The low pre-load connectors are typically used on conventional subsea completions while high pre-load connectors are used on non-conventional subsea completions where fatigue or high external loading is anticipated such as encountered with director overhead floating production systems or "horizontal" tree applications. These hydraulic systems typically include a reverse acting hydraulic "unlatch or unlock" function piston also. This function effects unlatch of the connector from the wellhead housing so that separation can take place. The unlatch hydraulic piston function typically can generate an unlatching force equal to or greater than the primary latching force. This is necessary to relieve the stored energy in the pre-loaded connection. In addition, a secondary mechanical back-up unlatch system is often required. This is a redundant safety system used should failure of the primary hydraulic unlatch function occur. These mechanical backup systems typically consist of vertically oriented rods which are attached to a vertical motion actuation (lock/unlock) ring. Typically, pulling up on the ring by means of the pull rods will cause the connector to unlatch independent of the hydraulic actuation system. Pulling on the rods is typically accomplished by means of a remotely installed hydraulic tool system or direct pull from an overhead vessel by means of diver or ROV (remotely operated vehicle)-installed pull cables from surface mounted winches.

In the 1980's, it was recognized that the expense of tree connectors with integral hydraulic actuation systems could be reduced in volume applications by removing the hydraulic (latch/unlatch) actuation system from the tree connector and mounting directly to the tree running tool. Latch and unlatch of the tree connector could then be effected by coupling the tree running tool-mounted hydraulic actuation system to the tree connector actuation ring by means of vertically mounted push-pull rods. The tree connector hydraulic actuation system included a reversible means to grab or grip the push-pull rods for purposes of pulling on the rods to effect unlatch. Push on the rods would effect latching. Additional advantages were realized in that failure modes associated with permanently installed hydraulic systems and the need for redundant hydraulic or mechanical unlatching systems were eliminated. This type of design is typically referred to as a "mechanical tree connector". These designs were limited to low pre-load conventional tree applications and design-wise, did not lend themselves to a high-preload application due to general tree running tool geometry restrictions and push-pull rod buckling limitations.

The development of the "through-bore" tree in the mid 1980's, and of the "horizontal" or "side valve" tree in the late 1980's and early 1990's led to increased industry consideration of landing a full-size BOP (Blow-out Preventer) stack on top of a subsea Christmas tree for purposes of workover. The external loading imposed by full-size (typically 18.75 inch) BOP stack and accompanying drilling riser system, especially in deep water, mandated a need for a high pre-load connector in this application. The typical integral hydraulic annular high pre-load connector has been typically employed. However, it was noted by the inventor that it would be desirable to be able to employ a "high preload mechanical connector" in this application also in order to drive the same cost and reliability benefits as was achieved on the low preload conventional applications.

OBJECTS OF THE INVENTION

It is an object of this invention to provide a high-preload mechanical tree connector and tree running tool combination.

It is further object of this invention to provide a full-bore high pressure sealing system to the top of the tree.

It is another object of this invention to provide a novel tree running tool emergency release/unlatch system.

SUMMARY OF THE INVENTION

The preferred tree running tool (TRT) design incorporates several design features which facilitate all aspects of the xmas tree installation/recovery process. A first feature is a hydraulic connector designed to externally latch to the Vetco mandrel profile on the top of the side valve tree (SVT) spool body while forming an internal pressure seal with the HX/VX gasket profile in the top face of the SVT spool body mandrel. This provides the capability to apply internal pressure into the spool body up to 10,000 p.s.i. (Operating). A second feature concerns the internal profile of the external latch connector which is configured to set and lock down a tree bore protector (TRB) in the SVT and to allow installation of the SVT with preinstalled TRB. A third feature is a hydraulic tree connector actuation system mounted to the outside of the TRT which is designed to interface with the SVT mechanical tree-to-wellhead connector for purposes of locking and unlocking the tree to and from the wellhead. This actuation system is further designed to provide a high preload to the tree connector/wellhead connection which is equivalent to standard connection systems, while providing the same lock/unlock force characteristics. Other features include the provision of visual position indicators for all primary functions; an emergency tool unlatch system in the event of hydraulic control system failure; fine alignment provisions for orienting the TRT to the SVT; and a manual make-up union-nut connection for connecting the drill pipe running string in the moonpool. The TRT is preferably employed with a four-funnel guide frame arranged on API spacing which includes a fixed hydraulic junction plate for makeup with the TRT hydraulic control umbilical junction box; a remote operated vehicle (ROV) hydraulic control line flying lead system for connection of the TRT-to-SVT hydraulic control functions; a grated working surface for personnel makeup/breakout of union nut connection and hydraulic control umbilical; and a personnel access ladder.

In accordance with one preferred aspect of the present invention, there is provided tree running tool with a mechanical mechanism for unlatching the tree running tool from a side valve tree. The tree running tool is formed from a tool body, a stem, a telescoping element, a retractable spacer, a means for moving the spacer, and a means for attaching the telescoping element to a lift device. The tool body has an upper end, a lower end, and a longitudinal axis.

The stem is fixedly attached to the upper end of the tool body and extends axially therefrom. The stem has a lower end attached to the tool body and a generally annular flange at a position spaced apart from the tool body. The telescoping element is positioned alongside the stem. The telescoping element has a generally annular flange at a position between the generally annular flange of the stem and the tool body. The retractable spacer is movable from an engaged position between the generally annular flange of the stem and the generally annular flange of the telescoping element, in which the spacer spaces the generally annular flange of the stem apart from the generally annular flange of the telescoping element, to a retracted position in which a void is formed between the generally annular flange of the stem and the generally annular flange of the sleeve. The means for moving the spacer is mounted to the tool body and the spacer for moving the spacer from the engaged position to the retracted position. The means for attaching the telescoping element to a lift device is mounted to the telescoping element.

In another aspect of the preferred embodiment of the invention, there is provided a method for mechanically unlatching a tree running tool from a side valve tree. The tree running tool comprises a tool body, a latch means, a hydraulic unit, and a shaft. The tool body has an upper end, a lower end, and a longitudinal axis. The latch means for latching the tree running tool to the side valve tree is mounted near the lower end of the tool body. The latch means includes an axially movable actuating element which moves from an upper disengaged position to a lower engaged position. The hydraulic unit is mounted to the upper end of the tool body. The shaft extends downwardly from the hydraulic unit for connecting the hydraulic unit to the actuating element. The hydraulic unit is operable for moving the shaft up and down to move the actuating element between the upper disengaged position and the lower engaged position. The method is carried out by providing a shaft extending upwardly from the hydraulic unit. The upwardly extending shaft is connected by a portion of the hydraulic unit to the downwardly extending shaft so that lifting upward on the upwardly extending shaft moves the downwardly extending shaft upward. By lifting upward on the upwardly extending shaft the latch means is moved to the disengaged position.

DETAILED DESCRIPTION OF THE PREFERRED EMBODIMENTS

General

Figure 1:
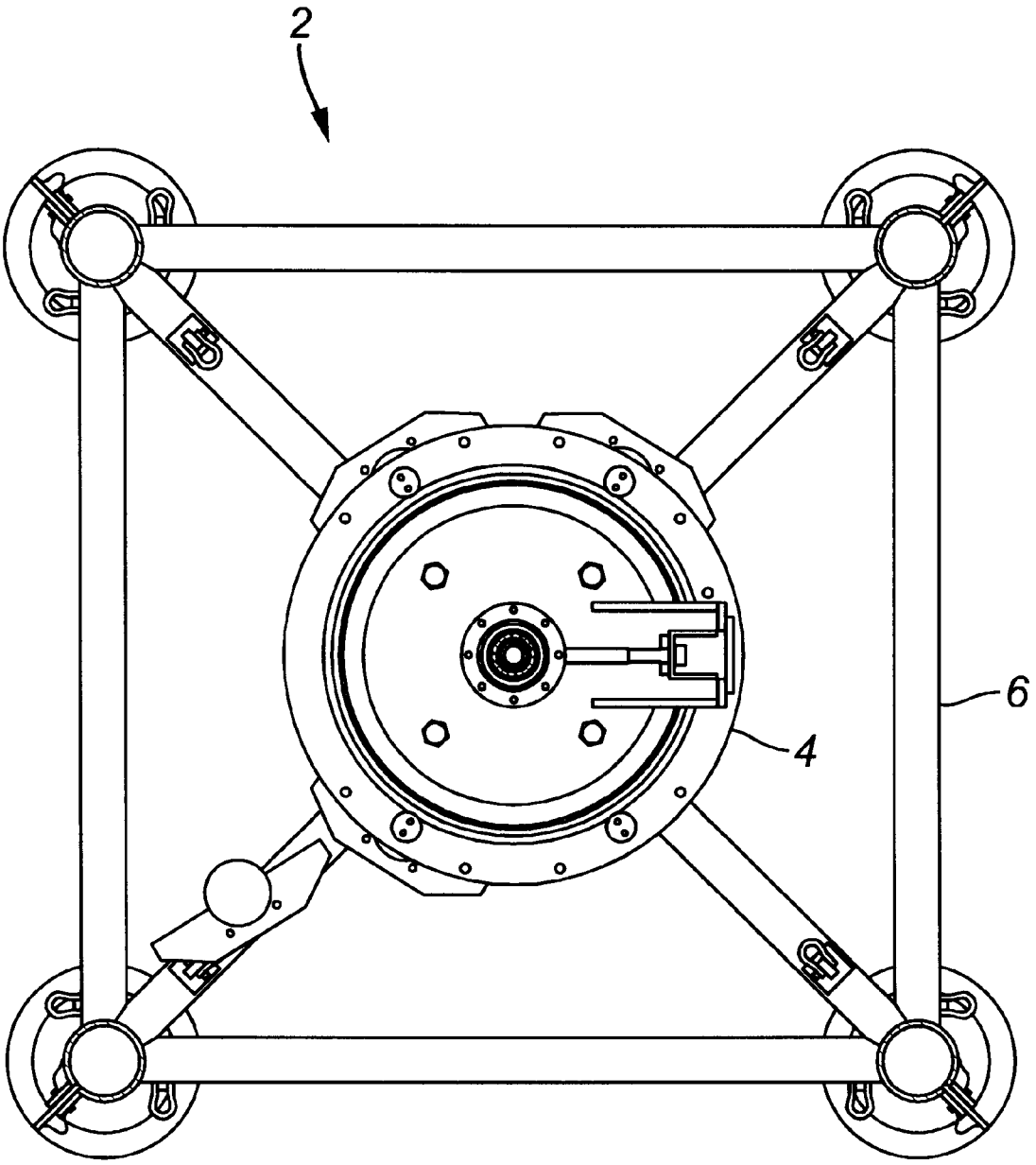
FIG. 1 is a top plan view of a tree running tool in accordance with certain aspects of the present invention.

The tree running tool latches to the horizontal tree by means of a split latching ring which engages a multi-groove profile on the outside (external) upper end of the horizontal tree spool body. The split locking ring is collapsed into the latching position by means of a vertically translated camming sleeve which has an inside diameter smaller than the relaxed outside diameter of the split latching ring. When fully collapsed, the split locking ring is fully supported on its outside diameter vertical face by the corresponding camming sleeve vertical face. This, in effect, provides complete radial support of the latching ring, preventing any possibility of accidental re-expansion of the latching ring (unlatch) under load. Pre-loaded connectors often are reliant on a shallow angle wedging principal which includes possibilities for unlatch should friction factors be low enough. This connection, however, is not preloaded in the sense as described above as it does not generate a clamping force between the running tool and the tree spool body. Therefore the force required to latch the running tool to the tree is the minimal force necessary to collapse the split latching ring, and in a relative sense, is extremely small when compared to the vertical latching force in a standard hydraulic preloaded connector. The very small latching force requirements allow usage of a minimal hydraulic cylinder actuation system which is very cost effective. Additionally, the low latching force system also allows for a very low force unlatching system. This too, reduces cost while facilitating low force emergency unlatch of the tree running tool from the tree, opening up new emergency release design possibilities. Therefore, as no preload is generated, the tool is not capable of compressing a metal sealing gasket like a standard pre-loaded connector. However, the tool does indeed seal to the top of the spool body at a conical gasket prep in the spool body. (This conical gasket prep is engaged by a BOP stack to effect a pressure tight connection between the stack and the tree during workover. Typically this is achieved with a high pre-load hydraulic BOP connector similar to as described for a conventional tree connectors above. As stated earlier, this type of metal seal relies on a significant clamping load in order to compress the metal seal and effect sealing.) The novel sealing arrange of the tree running tool with the top of the tree is accomplished with a floating piston arrangement inside the tree running tool The lower end of the piston ring is comprised of a male conical surface roughly corresponding in geometry to the conical corresponding female seal prep in the tree spool body. The piston conical shaped end includes an integral o-ring seal which is designed to seal against the face of the female prep. The piston ring also seals to the body of the tree running tool on a higher cylindrical diameter which is larger in diameter than the conical surface o-ring on the lower end of the piston ring. Belleville springs mounted between the top face of the piston ring and a lower mating face in the tree running tool body provide a small pre-load between the conical face of the piston ring seal and the female conical seal prep when the tree connector is latched to the spool body. As pressure is applied inside the seal ring, a net downward force is generated on the seal ring causing it to improve its seal with the spool body female prep as pressure increased.

Therefore, a high integrity, high pressure tight connection is achieved with a low force, zero pre-load connector. Additionally, the means of latching is not subject to accidental unlatch due to connector loading.

Due to the nature of the latching principal of the tree running tool connector, it is possible to provide a low force emergency unlatch system for the tree running tool which is ROV compatible and which can be effected very efficiently and quickly. Typical emergency release systems for high preload connectors require the installation of heavy and cumbersome pull cables by ROV or installation of some type of hydraulic intervention tool. These operations are typically very time consuming and can result in the expenditure of considerable sums of money when related to the cost-per-day of semi-submersible drilling vessels.

In the case of this invention, four hydraulic cylinder with tail rods effect latch and unlatch of the tree running tool connector to the tree spool body by means of the camming ring and split latching ring as described above. The tail rods of the hydraulic cylinders are connected to a plate which is centrally supported by an upward facing ledge on an inner telescoping drill pipe subassembly. Normally the telescoping drill pipe assembly is collapsed and the support ledge is prevented from moving upwards by a horizontal load bearing fork assembly. Emergency unlatch of the tree running tool latch mechanism is effected by retracing the fork assembly using a screw drive system rotated by an ROV installed torque tool After the fork is retracted, the drill pipe telescoping joint is allowed to be pulled upwards by the drill pipe running string. This in turn pulls on the support plate, and in turn the hydraulic cylinder tails rods, and in turn, the camming ring; finally effecting unlatch of the tool. Continued pulling the drill string removes the running tool from the horizontal tree, allowing recovery.

Overview of FIGS. 1–17

The tree running tool 2 shown in FIG. 1 (hereinafter TRT) is preferably composed of a central body 4 and a guide frame 6.

Figure 2:
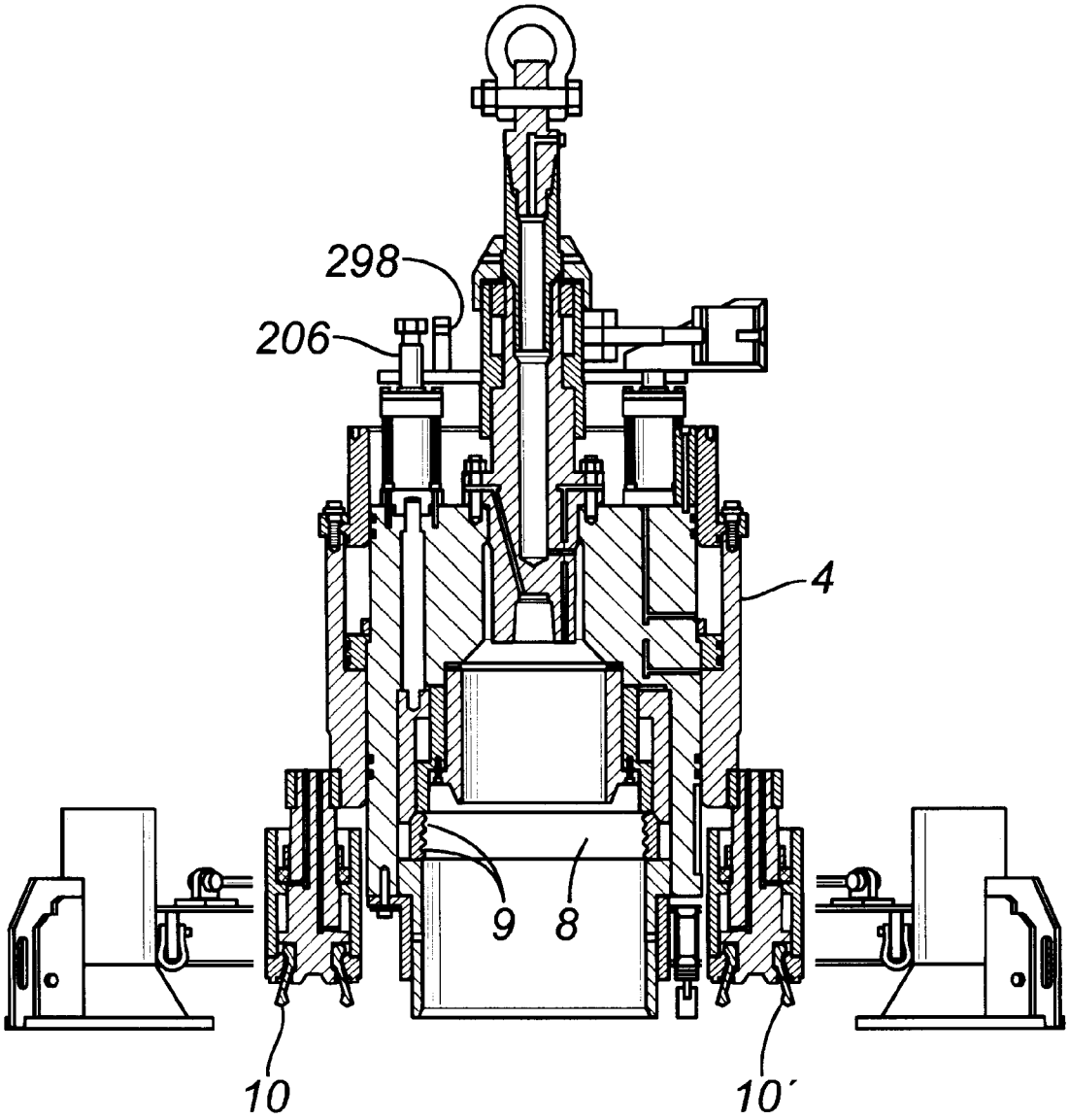
FIG. 2 is a side view of the tree running tool of FIG. 1 showing the tool body in section and portions of the surrounding guide frame in a pictorial representation.
Figure 18:
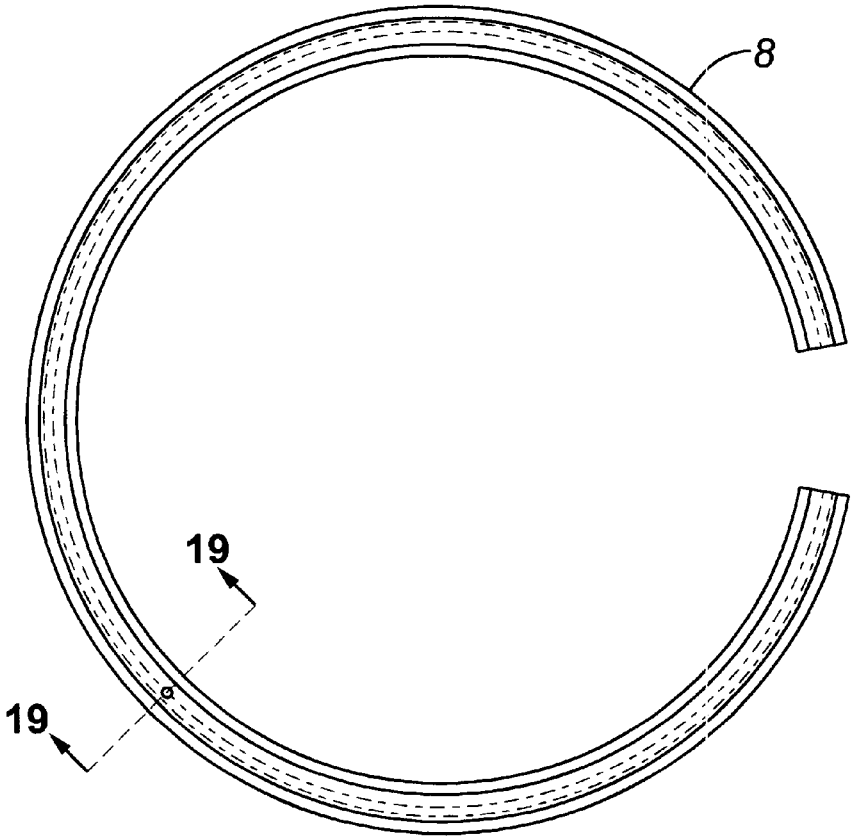
FIG. 18 is a plan view of a locking ring employed in the illustrated device.
Figure 19:
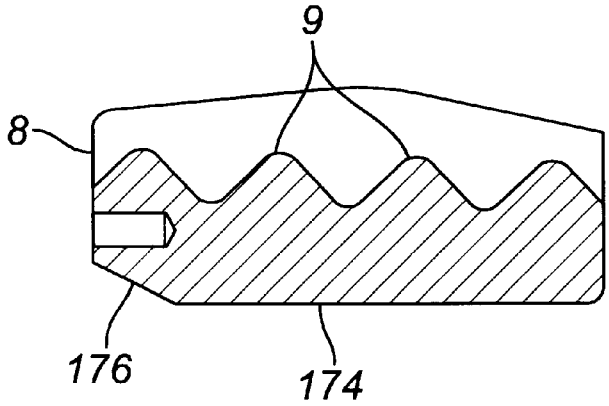
FIG. 19 is a cross sectional view of the locking ring shown in FIG. 18 taken along lines 19—19.

As shown in FIG. 2, the central body 4 preferably carries an internal split locking ring 8 and a plurality of external peripherally connector units 10, 10'. The split locking ring 8 is preferably provided with a plurality of circumferentially extending internal ridges 9. The preferred locking ring is further shown in FIGS. 18 and 19.

Figure 3:
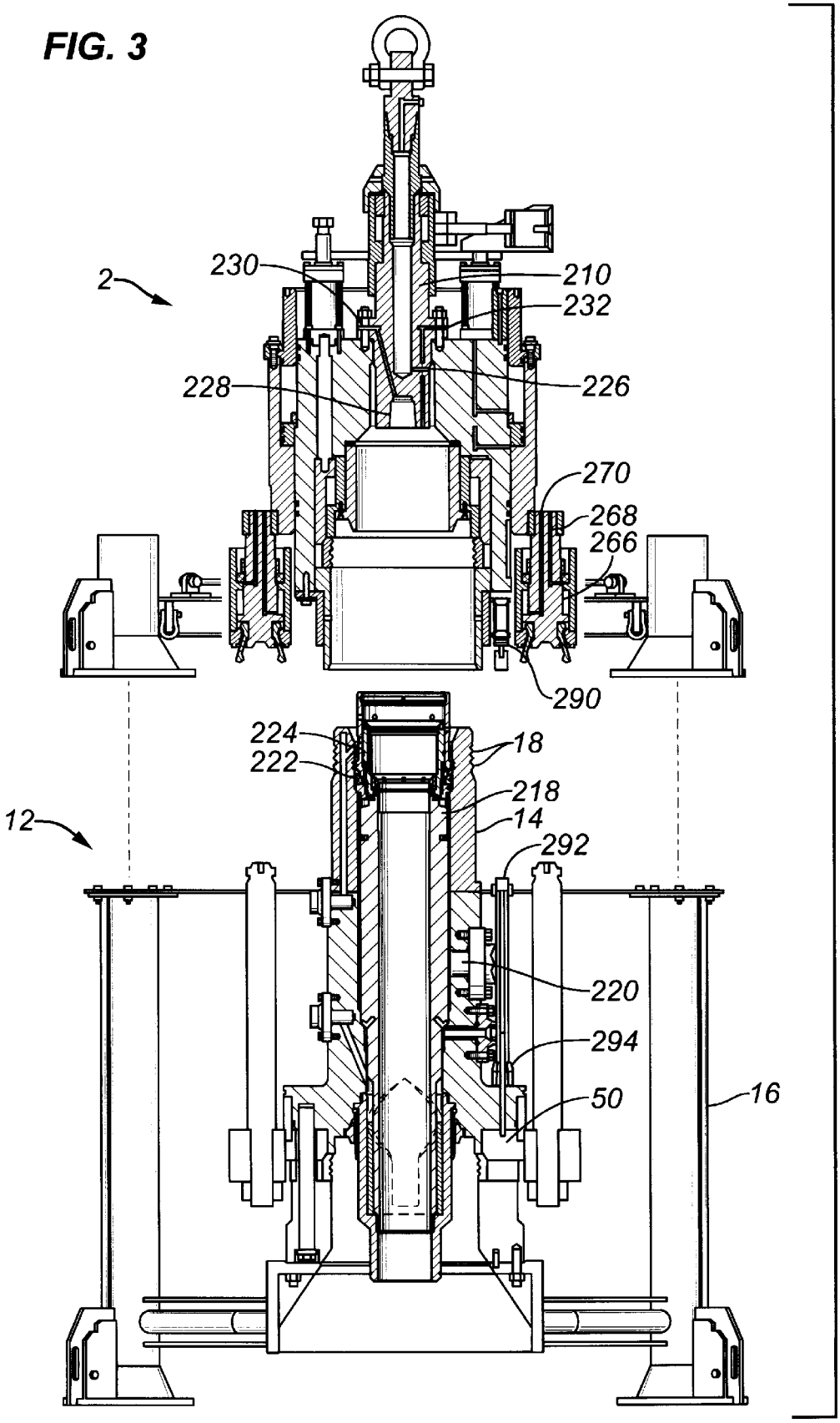
FIG. 3 shows the tree running tool being lowered onto a side valve tree.

As shown in FIG. 3, the TRT 2 is preferably configured for mounting and latching to a side valve tree 12 (hereinafter, SVT). The SVT is preferably composed of a central body 14 and a guide frame 16. The upper end of central body 14 is preferably provided with circumferentially extending external grooves 18.

Figure 4:
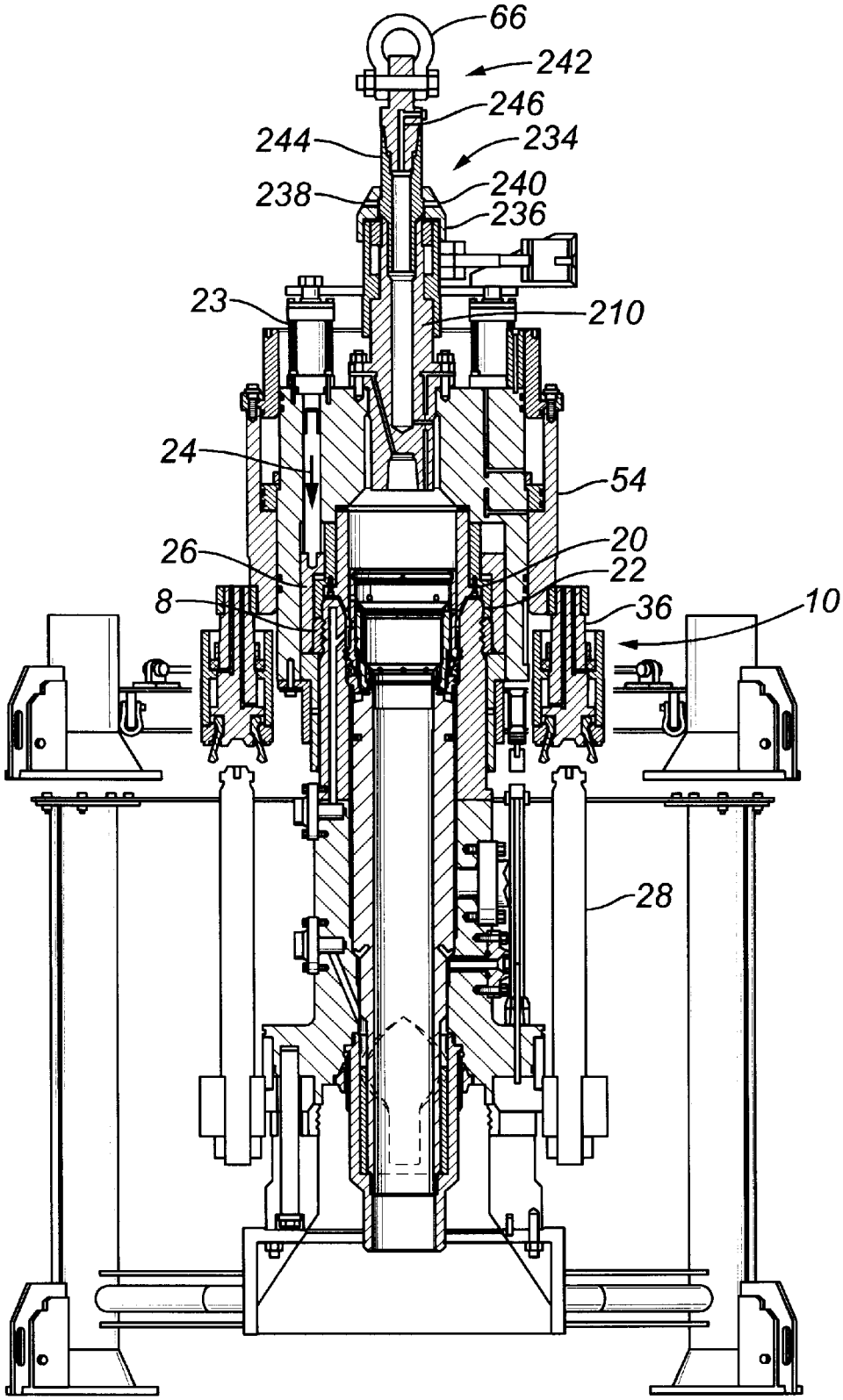
FIG. 4 shows the tree running tool latching the to upper end of the side valve tree.
Figure 5:
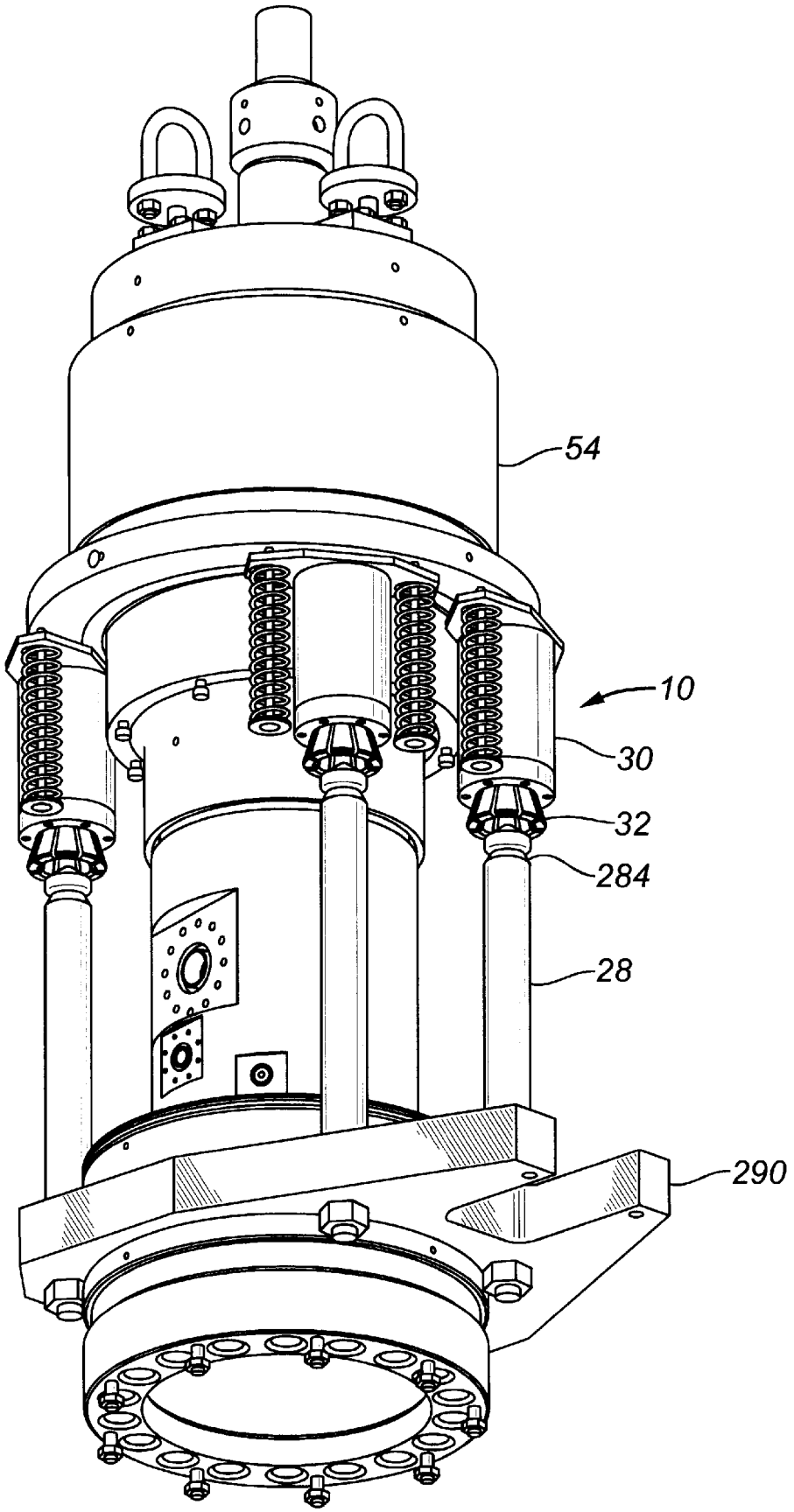
FIG. 5 is a pictorial representation of a portion of the outside of a similar tree running tool and side valve tree as shown in FIG. 4.

As shown in FIG. 4, as the TRT 2 lands on the upper end of the SVT 12, the ridges on the locking ring 8 align radially outward from the grooves at the upper end of the SVT. The TRT 2 is rotated until an orientation pin 20 extending from the central body of the TRT engages with a hole 22 at the upper end of the SVT. A hydraulic cylinder 23 is then actuated to push down on a shaft as indicated by arrow 24 to move all internal sliding actuator sleeve 26 alongside the split locking ring 8 to collapse the ridges on the ring into the grooves on the SVT and lock the TRT to the SVT.

After orientation, connector units 10 axially align with connector posts 28 mounted to the SVT. The connector units 10 preferably include shafts 36 which are fixedly mounted to an external sliding actuator sleeve 54 mounted to the central body 4 of the TRT and are preferably provided with collet latch fingers 32 at their lower end. See also FIG. 5. Fluid pressure is supplied to move the actuator sleeve 54 down as indicated by arrow 55 (See FIG. 6) to urge the sliding sleeve into an intermediate position and lower the collet latch fingers 32 to a position circumferentially alongside the upper end of the connector posts 28. The collet latch fingers 32 are then made to close on the connector posts by utilizing fluid pressure to urge the collet latch housings 30 over collet latch fingers 32.

Figure 6:
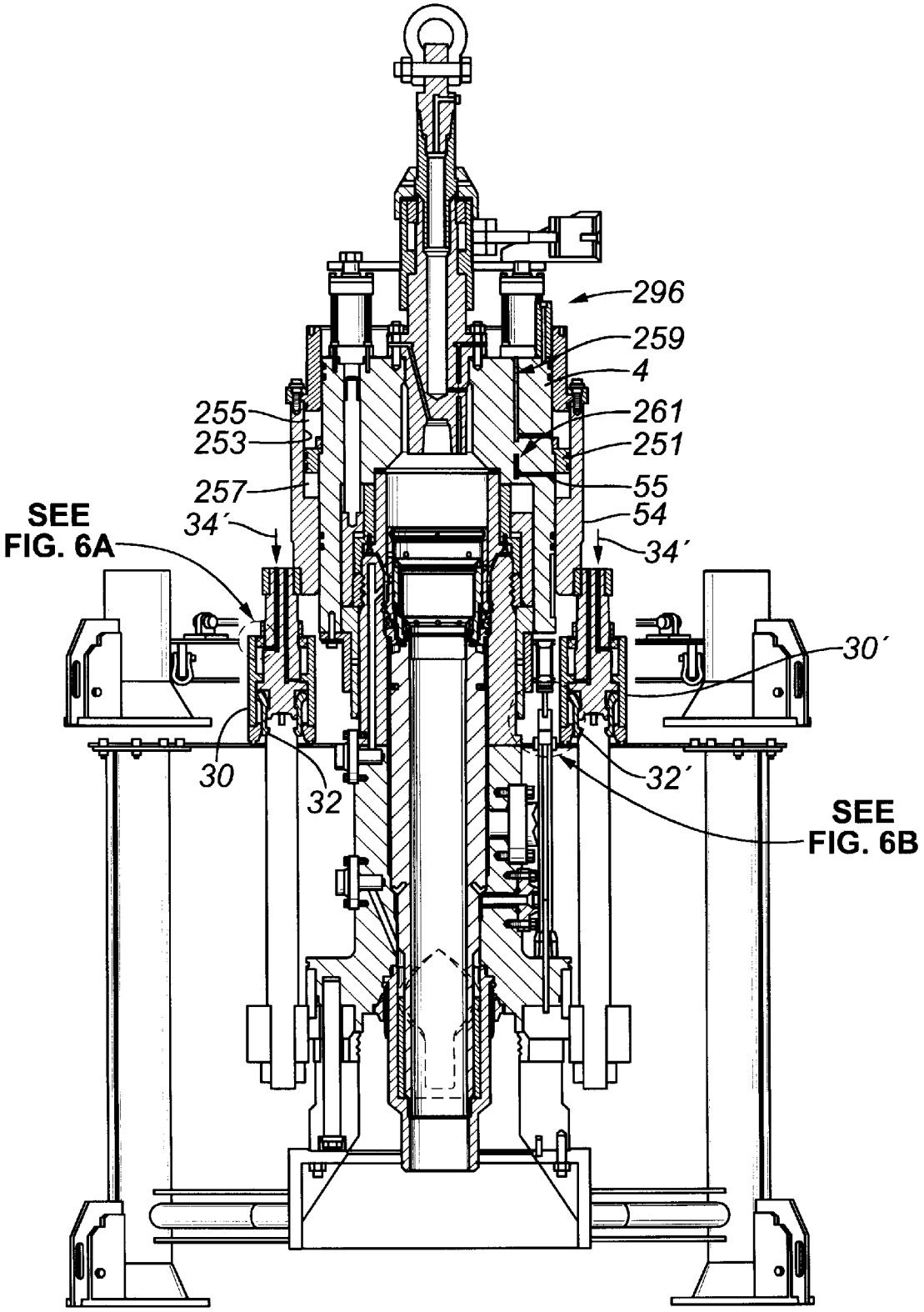
FIG. 6 shows further latching of the tree running tool to the side valve tree.

As shown in FIG. 6, the external sliding actuator sleeve 54 is in the intermediate position and fluid pressure indicated by arrows 34, 34' pushes the collet latch housings 30, 30' over collet latch fingers 32, 32' to further latch the TRT to the SVT.

Figure 7:
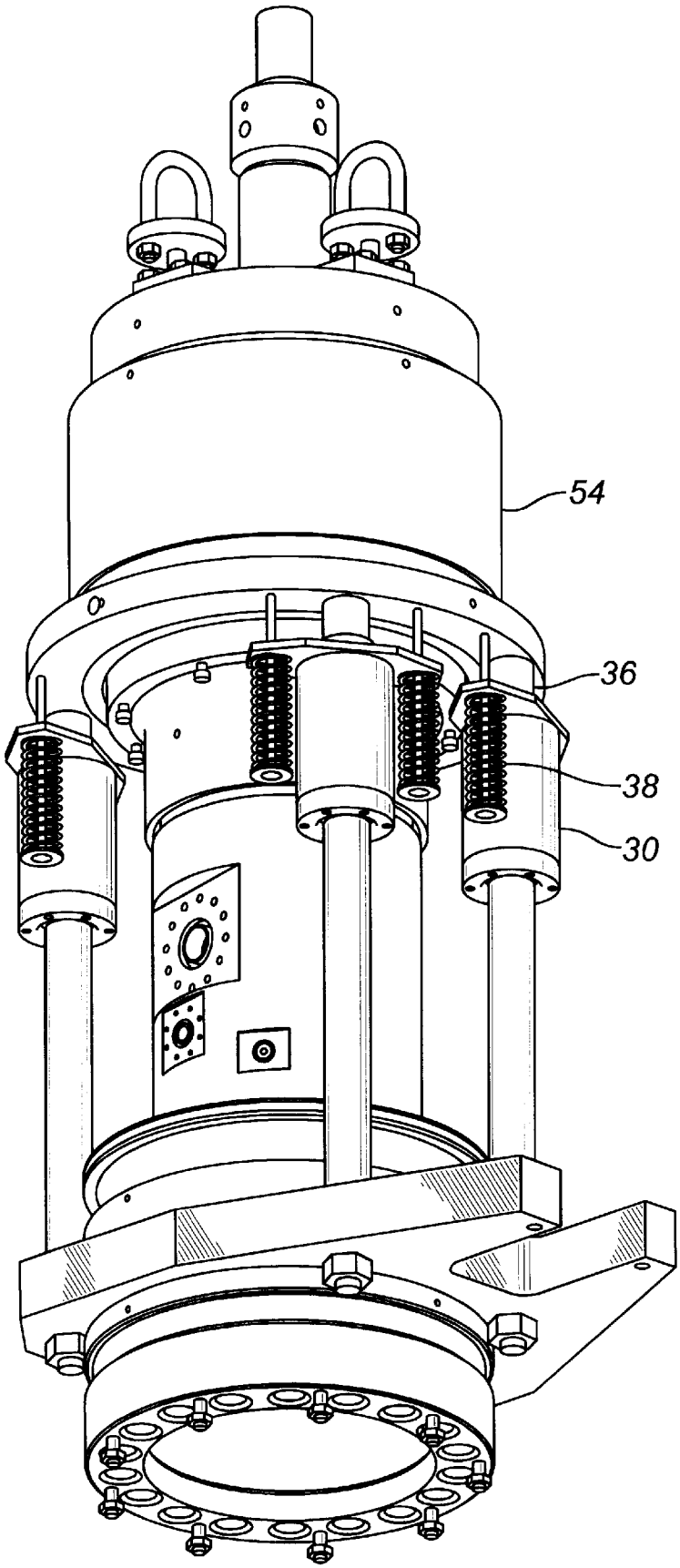
FIG. 7 is a pictorial representation of a portion of the outside of a similar tree running tool and side valve tree as shown in FIG. 6.

As shown in FIG. 7, collet latch shafts 36 are fixedly mounted with respect to the external sliding actuator sleeve 54. The collet latch housings 30 are spring biased by springs 38 toward the unlatched positioned.

Figure 8:
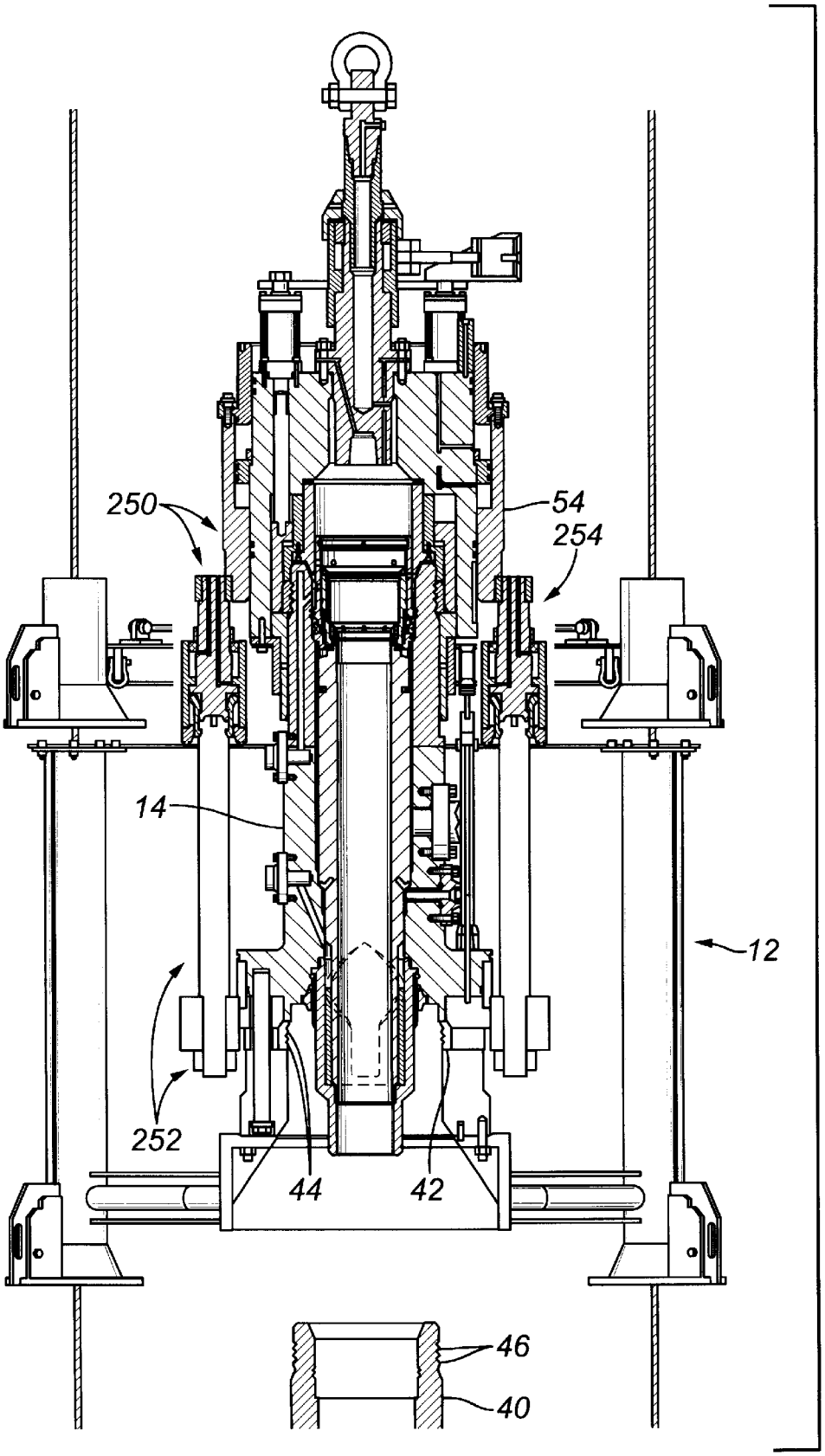
FIG. 8 shows the tree running tool and side valve tree being lowered onto a subsea wellhead.

As shown in FIG. 8, the SVT 12 is configured for mounting and latching to subsea wellhead 40. The central body 14 of the SVT carries an internal split locking ring 42. The split locking ring 42 is preferably provided with a plurality of circumferentially extending internal ridges 44. The upper end of the wellhead is provided with circumferentially extending external grooves 46.

Figure 9:
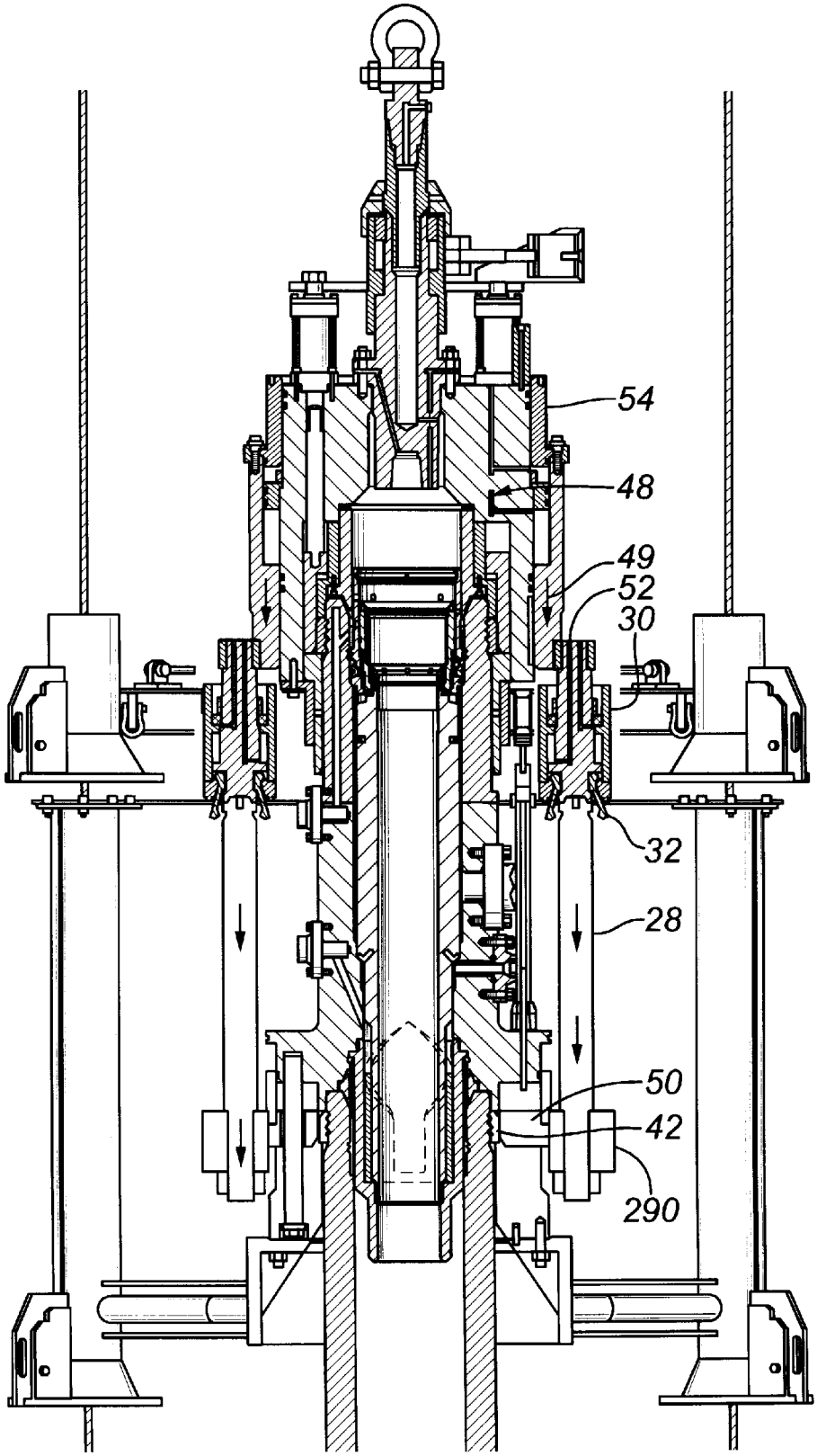
FIG. 9 shows the tree running tool and side valve tree landing and locking to the upper end of the subsea wellhead.

As shown in FIG. 9, as the SVT 12 lands on the upper end of the wellhead, the ridges on the locking ring 42 align radially outward from the grooves at the upper end of the wellhead 40. Fluid pressure as indicated by arrows 48 is then supplied to move the external sliding actuator sleeve 54 in the down position as shown by arrows 49, pushing down on connector posts 28 thereby urging the internal sliding actuator sleeve 50 alongside the split locking ring 42 to collapse the ridges on the ring into the grooves on the wellhead and lock the SVT to the wellhead. Fluid pressure is then supplied as indicated by arrow 52 to move the collet latch housings 30 to the unlatched position and release collet fingers 32 from connector posts 28.

Figure 10:
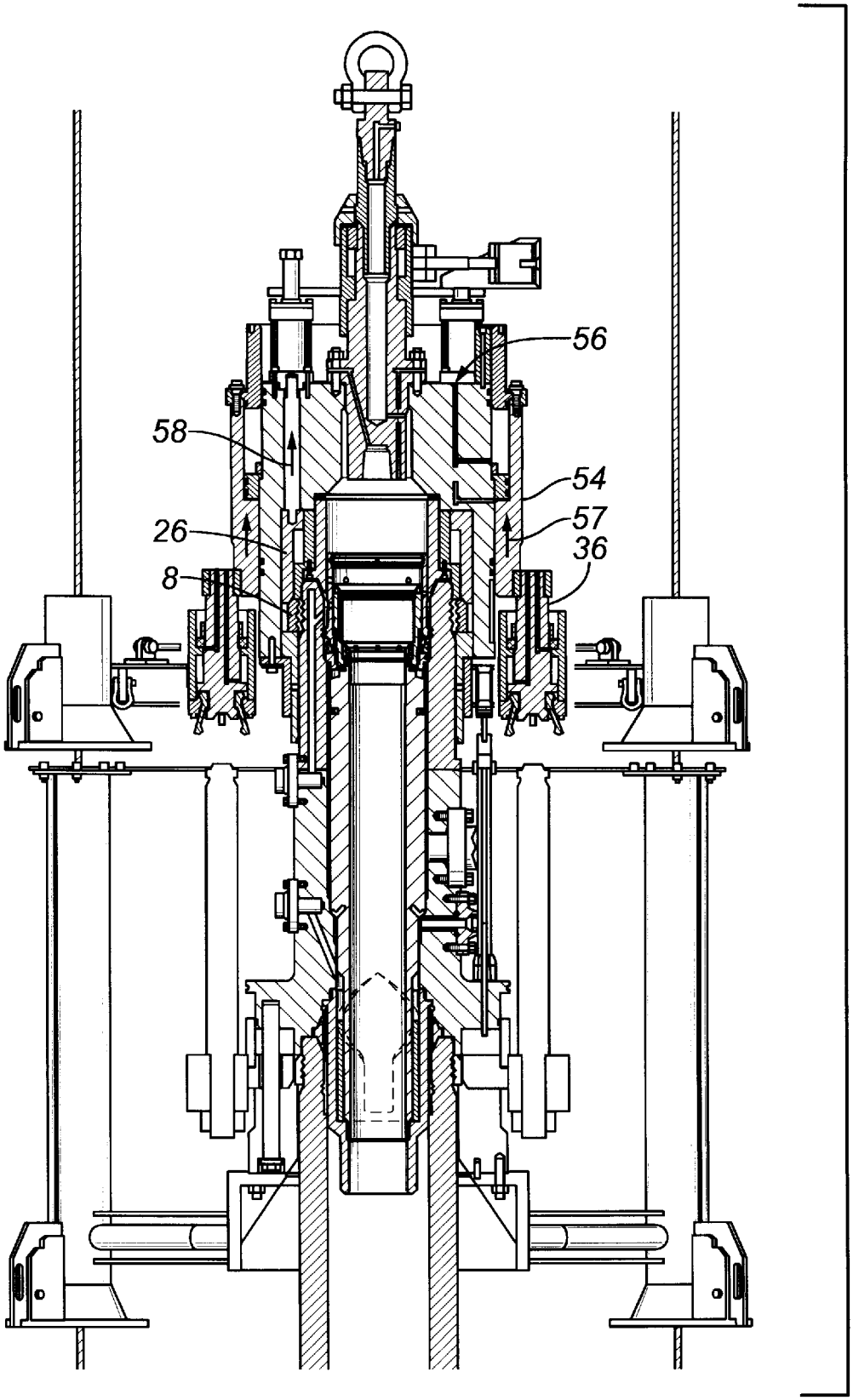
FIG. 10 shows unlatching the tree running tool from the side valve tree and the subsea wellhead for routine retrieval.

As shown in FIG. 10, fluid pressure is supplied as indicated by arrow 56 to urge the external sliding actuator sleeve 54 into a retracted position as shown by arrows 57 and raise the collet fingers 32 above the connector posts 28. Fluid pressure is supplied to the hydraulic cylinders 23 to raise a connecting shaft as indicated by arrows 58 and move the internal sliding actuator sleeve 26 from alongside the split locking ring 8 and permit the ring to expand to unlock the TRT from the SVT.

Figure 11:
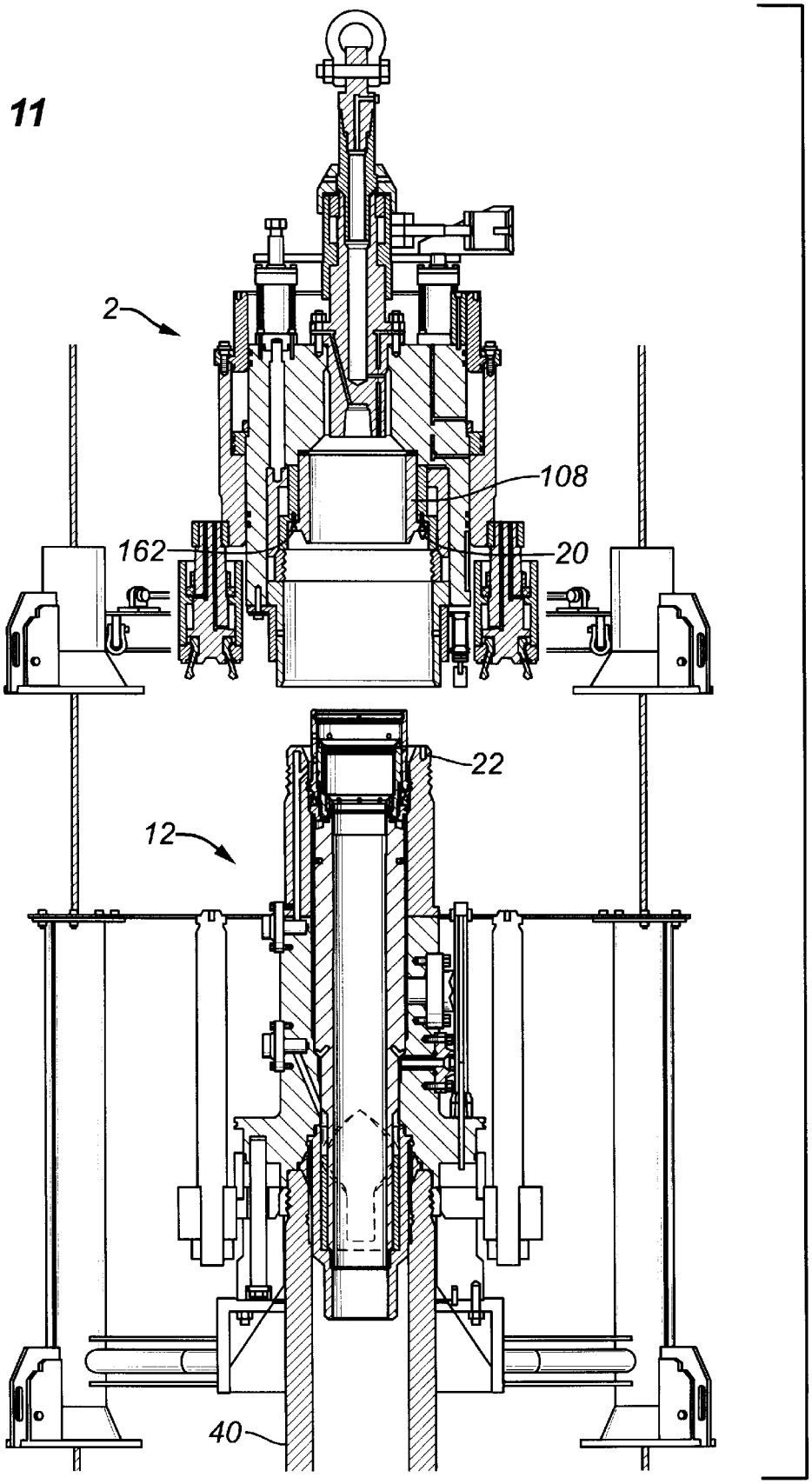
FIG. 11 shows routine retrieval of the tree running tool.

As shown in FIG. 11, the TRT 2 can then be retrieved, leaving the SVT 12 installed on the wellhead 40.

Figure 12:
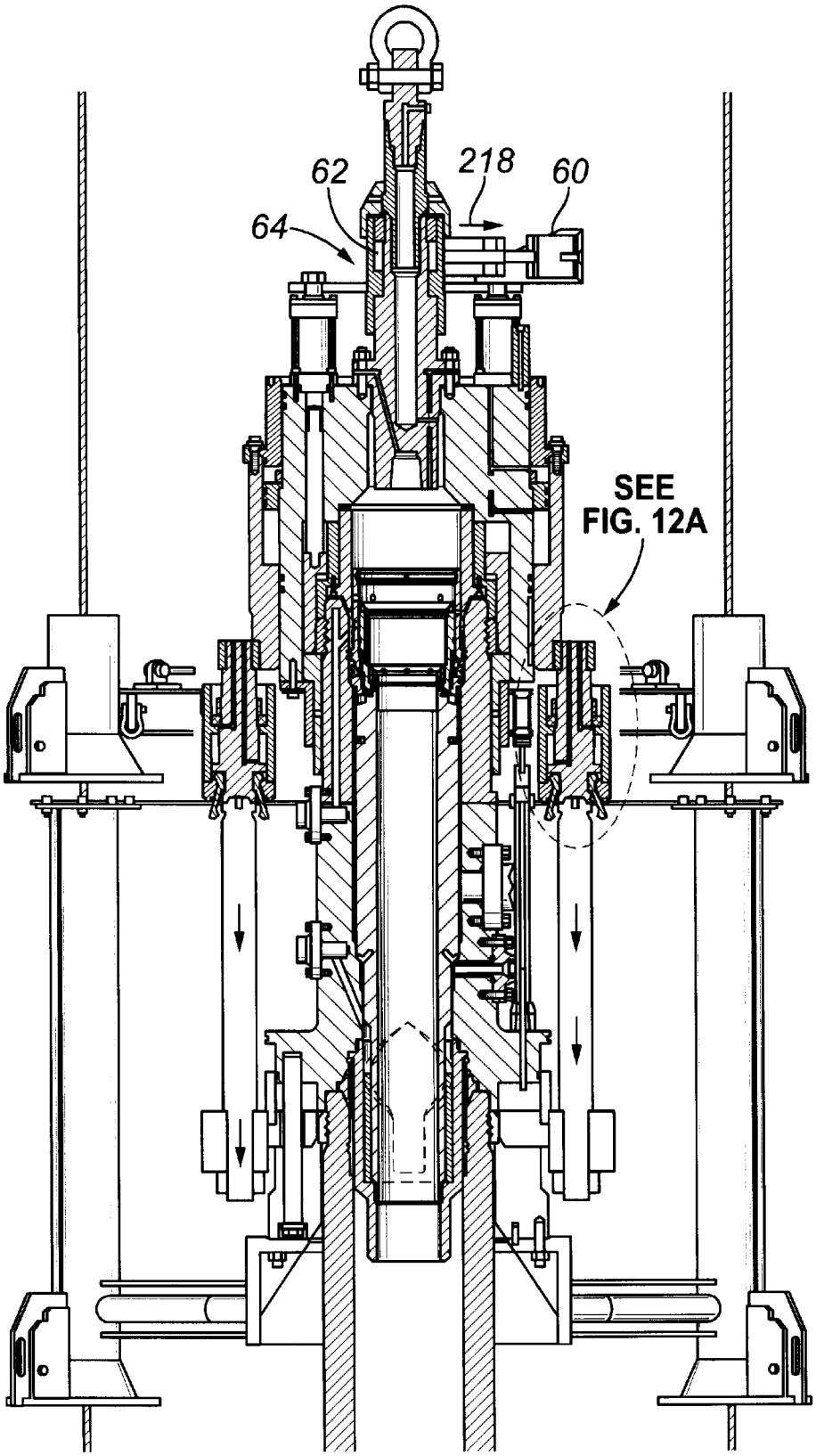
FIG. 12 shows unlatching the tree running tool from the side valve tree and wellhead for emergency retrieval.
Figure 12A:
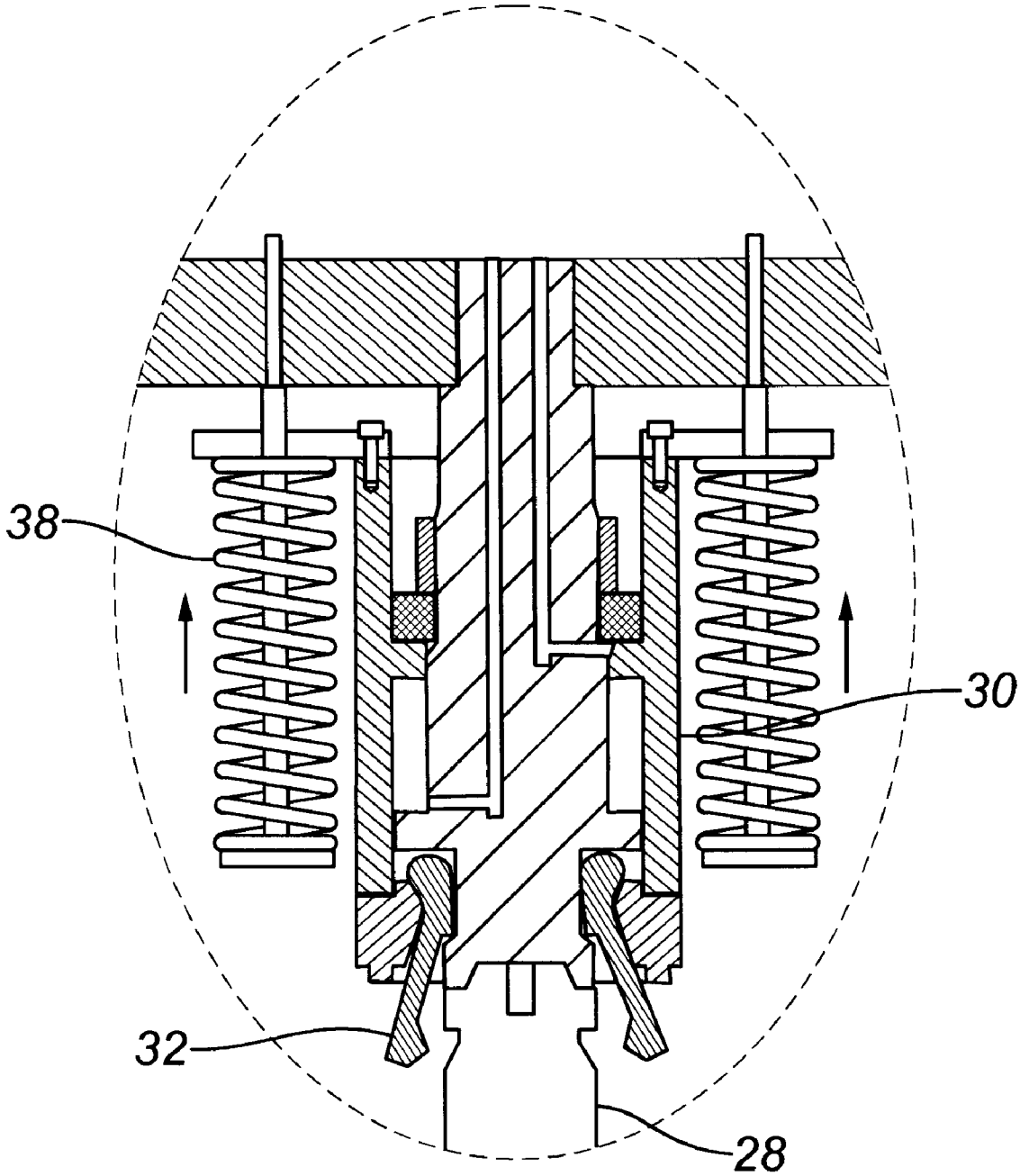
FIG. 12A shows a portion of the device of FIG. 12 in greater detail.

As shown in FIG. 12, the TRT can be prepared for emergency retrieval by first cutting all fluid supply lines, such as with an ROV. As shown in FIG. 12 A, the coil springs 38 will urge collet latch housings 30 into the unlatched position, disengaging the collet latch fingers 32 from posts 28. A fitting in an ROV bucket 60 is then manipulated operate a drive screw 218 and retract a load transfer element which locks a telescoping assembly 64 at the upper end of the TRT in a collapsed configuration, from a chamber 62.

Figure 13:
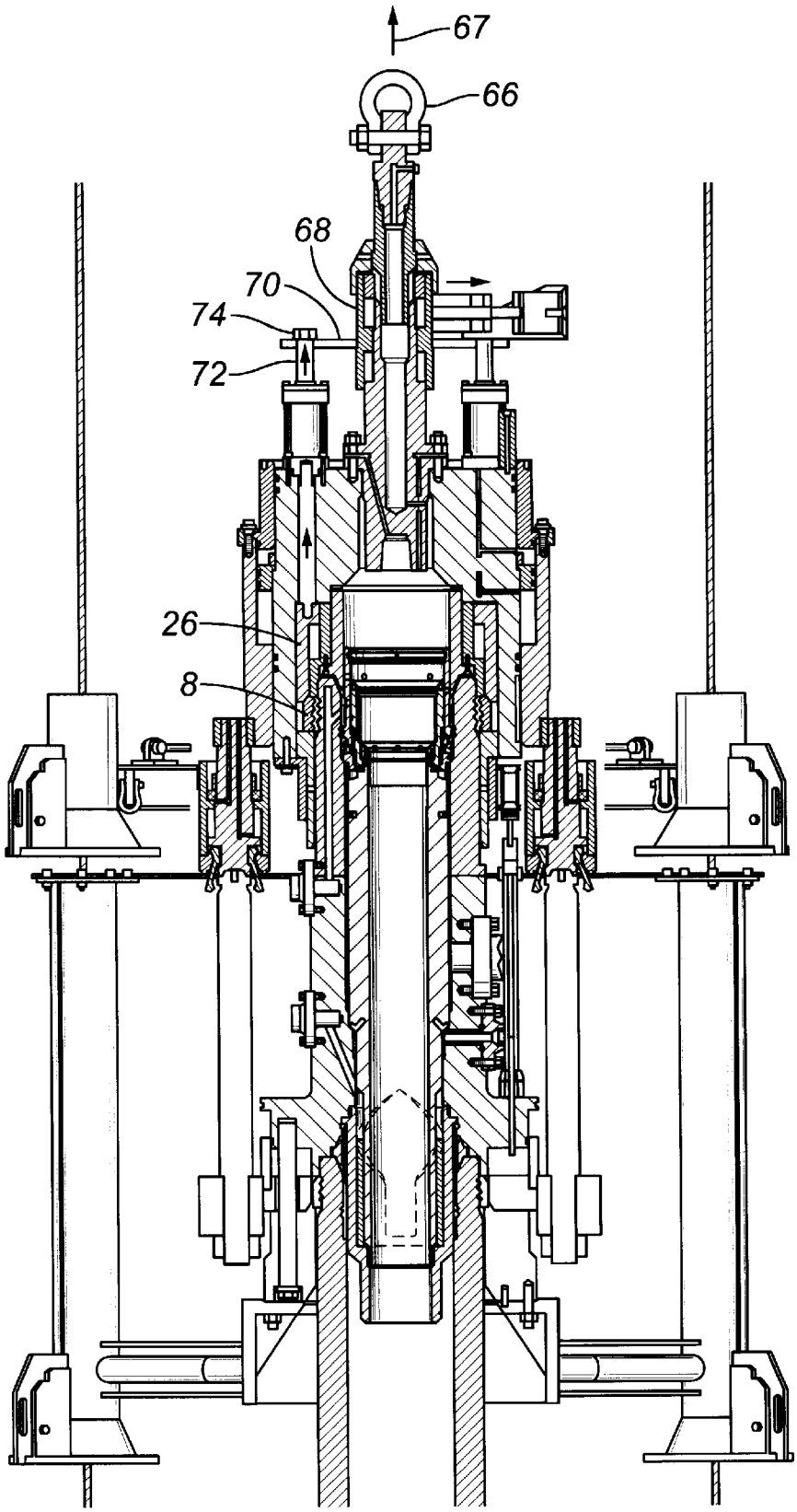
FIG. 13 shows further unlatching of the tree running tool from the side valve tree and wellhead for emergency retrieval.

As shown in FIG. 13, after retraction of the load transfer element, pulling up on lifting ring 66 as indicated by arrow 67 will permit an outer telescoping sleeve 68 of the telescoping assembly to slide upwardly relative to the lower portion of the TRT. The outer telescoping sleeve 68 carries a radially outwardly extending frame 70 having an aperture therethrough though which a shaft 72 extends having a head or nut 74 at the upper end which is too large to pass through the aperture. The shaft is connected to the sliding internal actuator sleeve 26. Pulling up on the lifting ring thus mechanically moves the sliding internal actuator sleeve 26 from alongside the split locking ring 8 and permits the ring to expand to unlock the TRT from the SVT.

Figure 14:
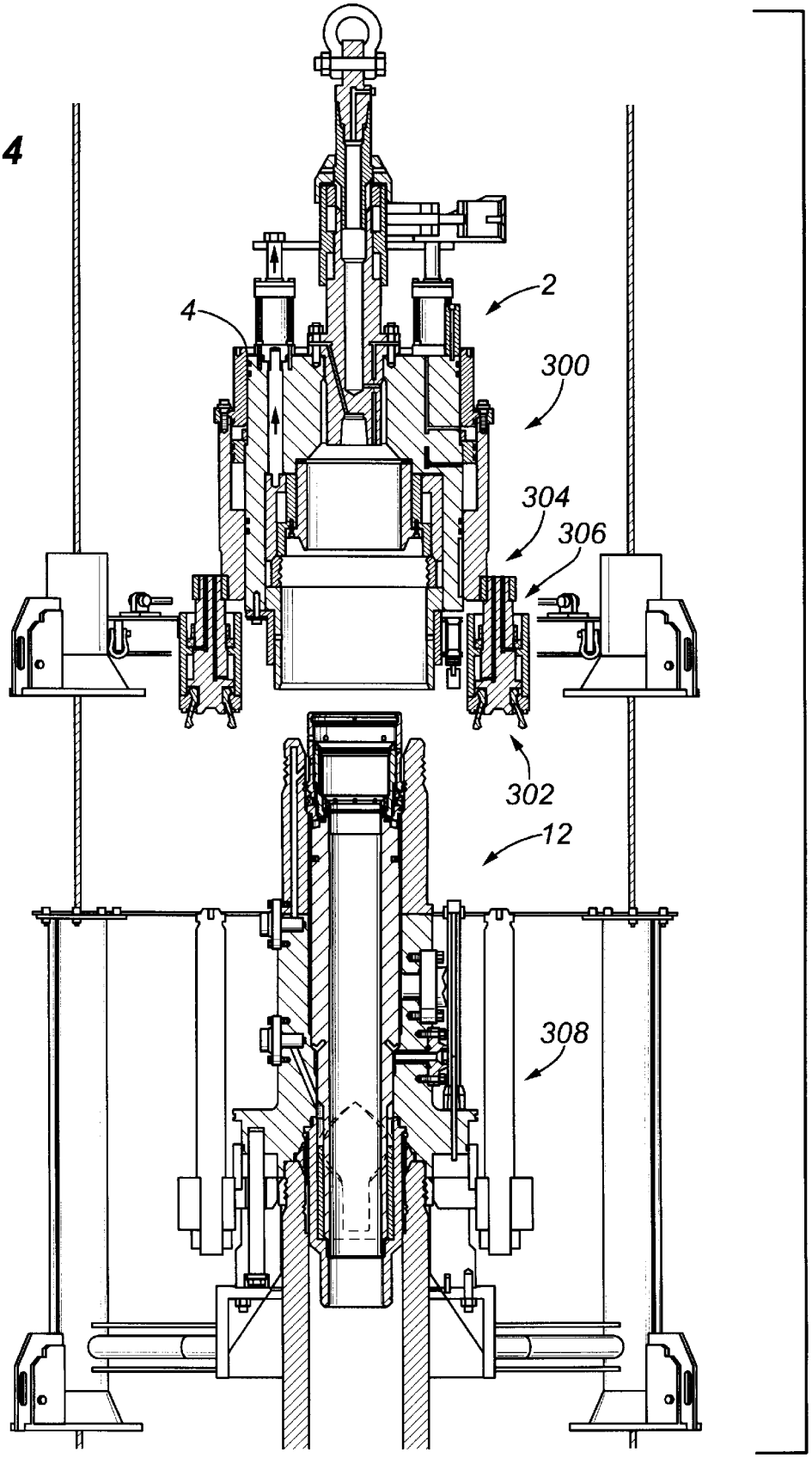
FIG. 14 shows emergency retrieval of the tree running tool.

FIG. 14 illustrates the TRT being retrieved after this operation.

Figure 15:
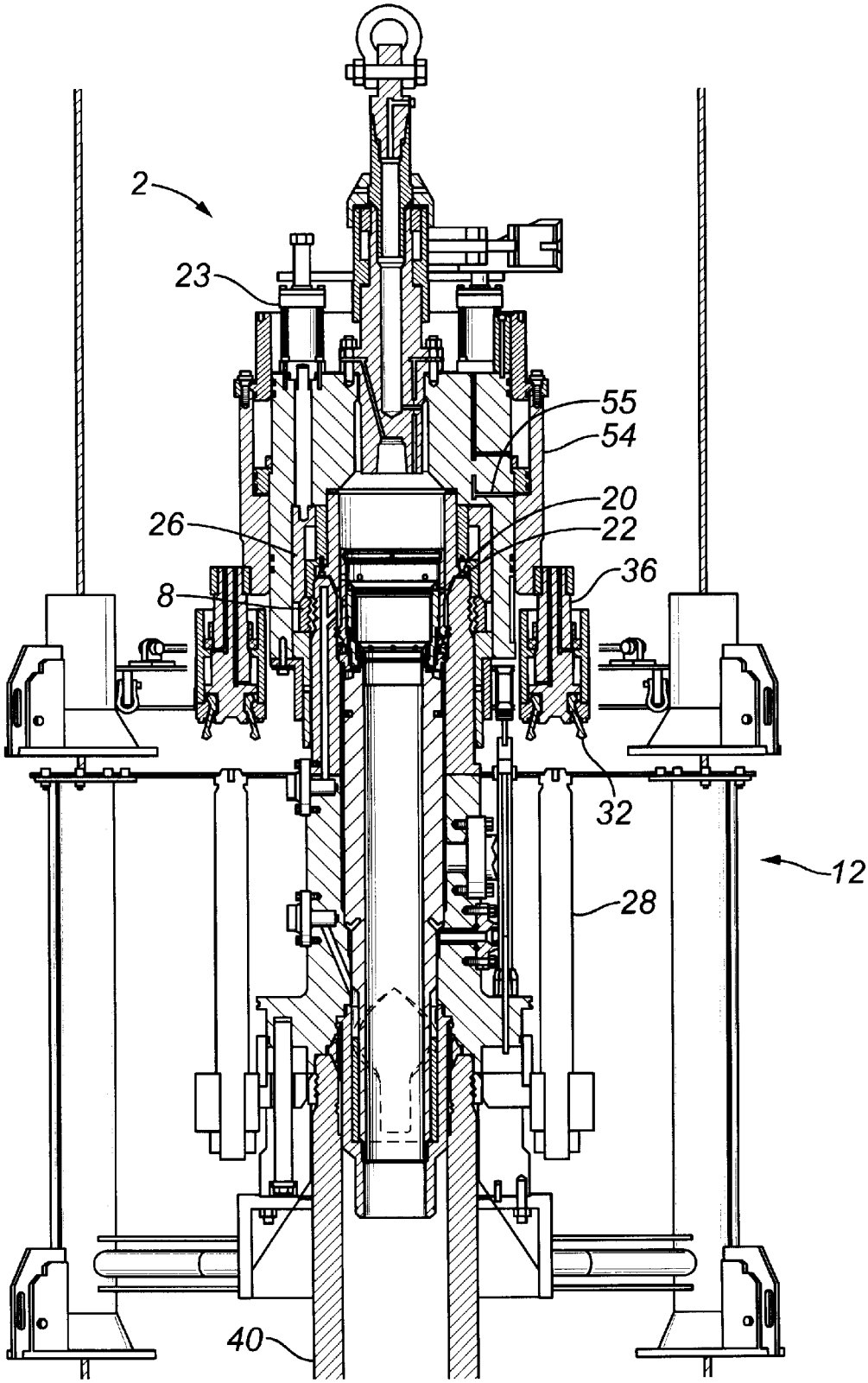
FIG. 15 shows landing and latching the tree running tool to a subsea side valve tree.

FIG. 15 illustrates the TRT 2 being landed and latched on a SVT 12 previously installed on a wellhead 40. As the TRT 2 lands on the upper end of the SVT 12, the ridges on the locking ring 8 align radially outward from the grooves at the upper end of the SVT. The TRT 2 is rotated until an orientation pin 20 extending from the central body of the TRT engages with a hole 22 at the upper end of the SVT. Hydraulic cylinder 23 is then actuated to move the sliding actuator sleeve 26 alongside the split locking ring 8 to collapse the ridges on the ring into the grooves on the SVT and lock the TRT to the SVT. Fluid pressure is then supplied via line 55 to urge the external sliding actuator sleeve 54 into an extended position and lower the collet fingers 32 to alongside the upper end of the connector posts 28.

Figure 16:
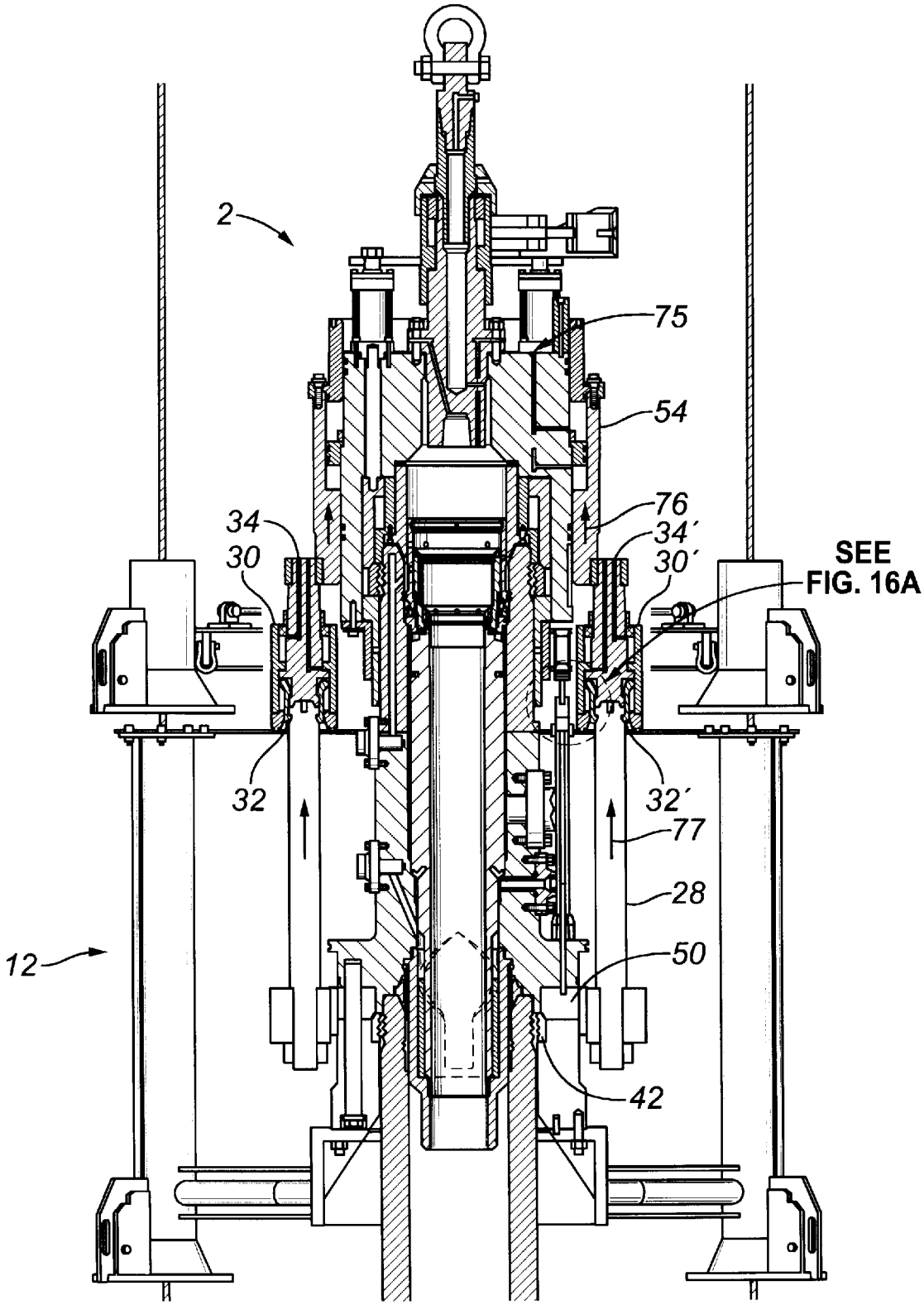
FIG. 16 shows unlocking the subsea side valve tree from the subsea wellhead.
Figure 16A:
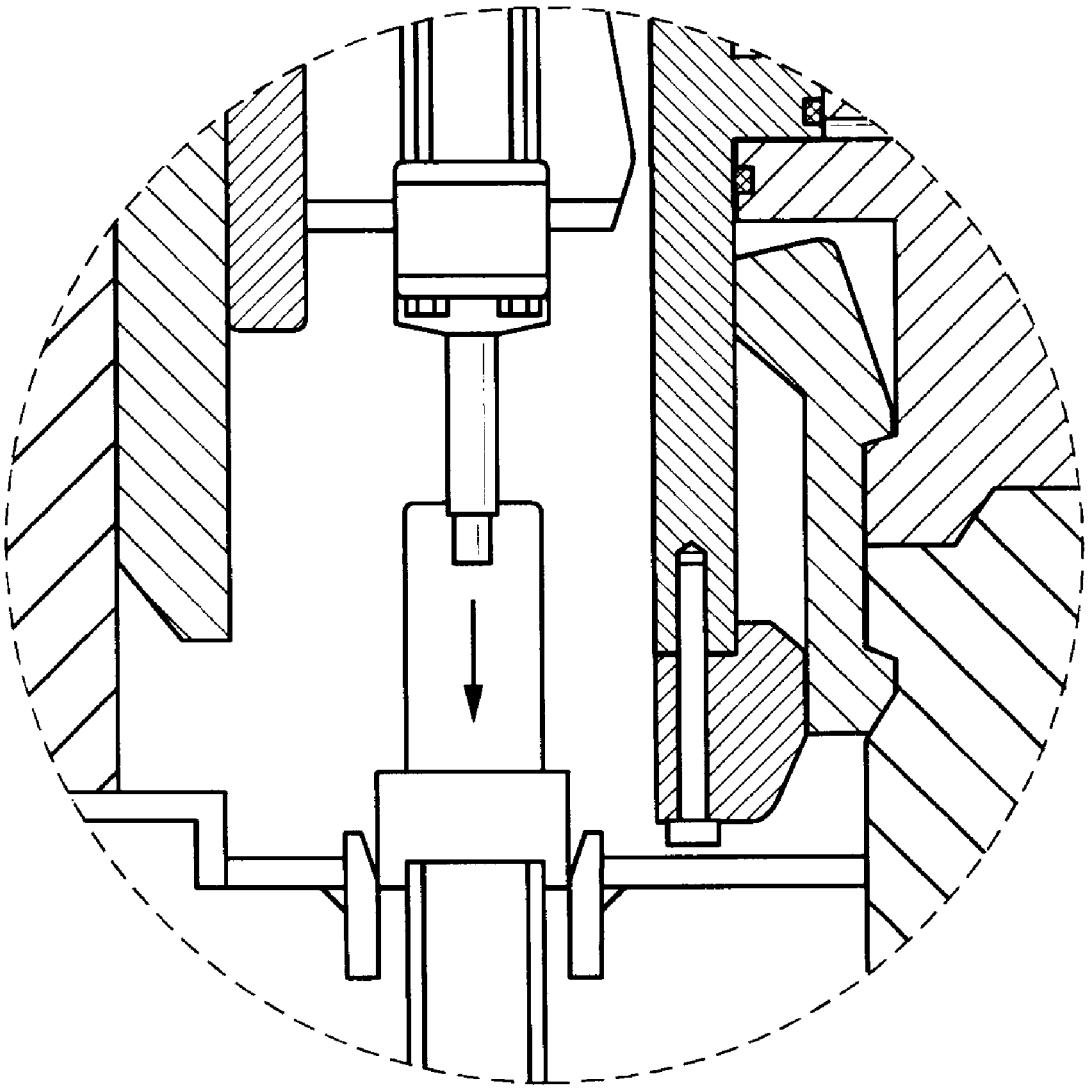
FIG. 16A show a portion of the device of FIG. 16 in greater detail.

As shown in FIG. 16, the TRT 2 is further latched to the SVT 12 by applying fluid pressure as indicated by arrows 34, 34' to push the collet latch housings 30, 30' over collet latch fingers 32, 32'. Fluid pressure is applied to a port 75 to raise the sliding actuator sleeve 54 as indicated by arrows 76, pulling up on connector posts 28 as indicated by arrows 77 to retract the internal sliding actuator sleeve 50 from alongside the split locking ring 42, permitting the split locking ring to expand and unlock lock the SVT 12 from the wellhead 40. FIG. 16A illustrates unlocking a secondary SVT to wellhead lockdown.

Figure 17:
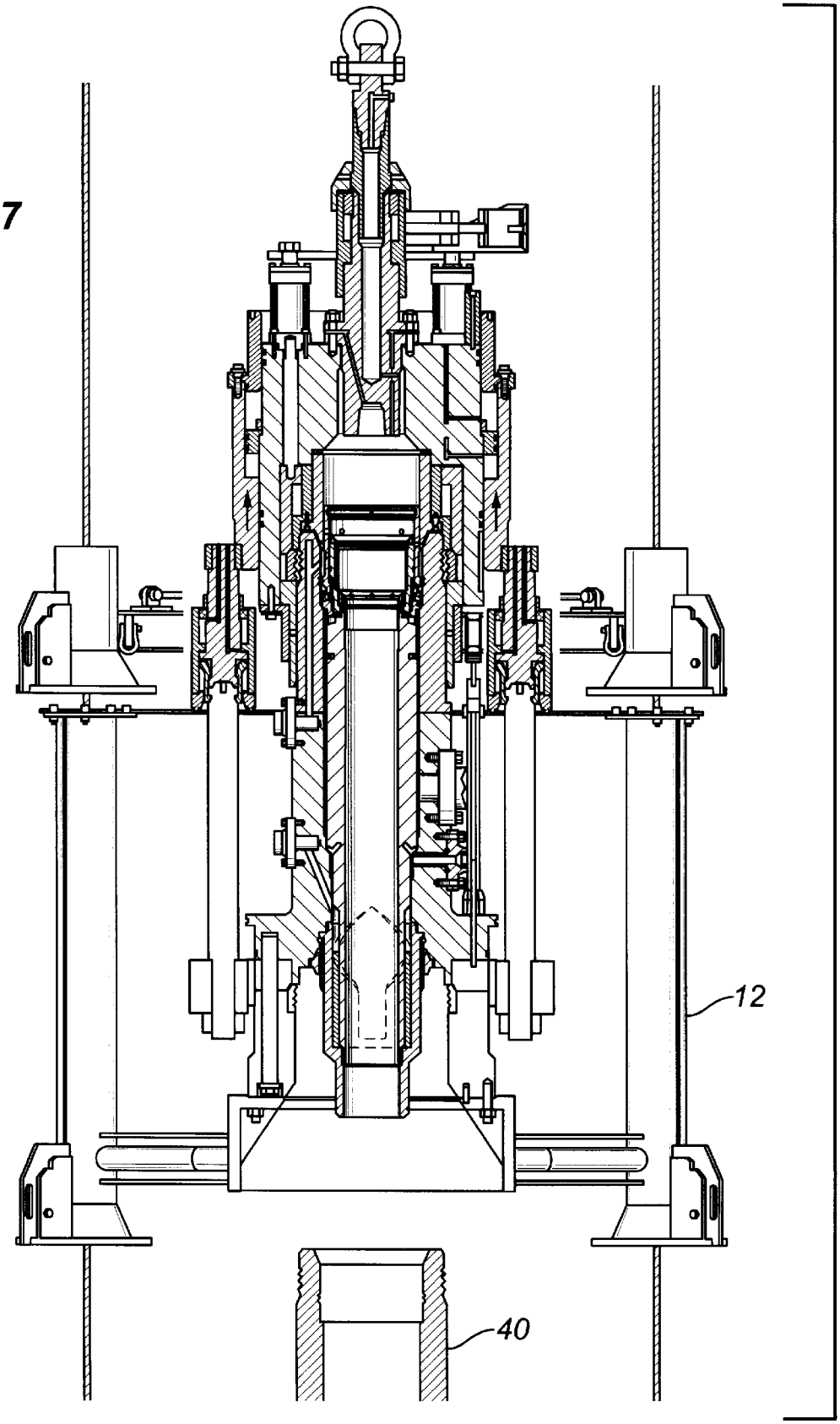
FIG. 17 shows retrieving the side valve tree and tree running tool from the subsea wellhead.

As shown in FIG. 17, the SVT 12 can then be retrieved from the wellhead 40.

DETAILED DESCRIPTION OF PREFERRED DESIGN FEATURES

TRT to SVT Seal

Figure 20:
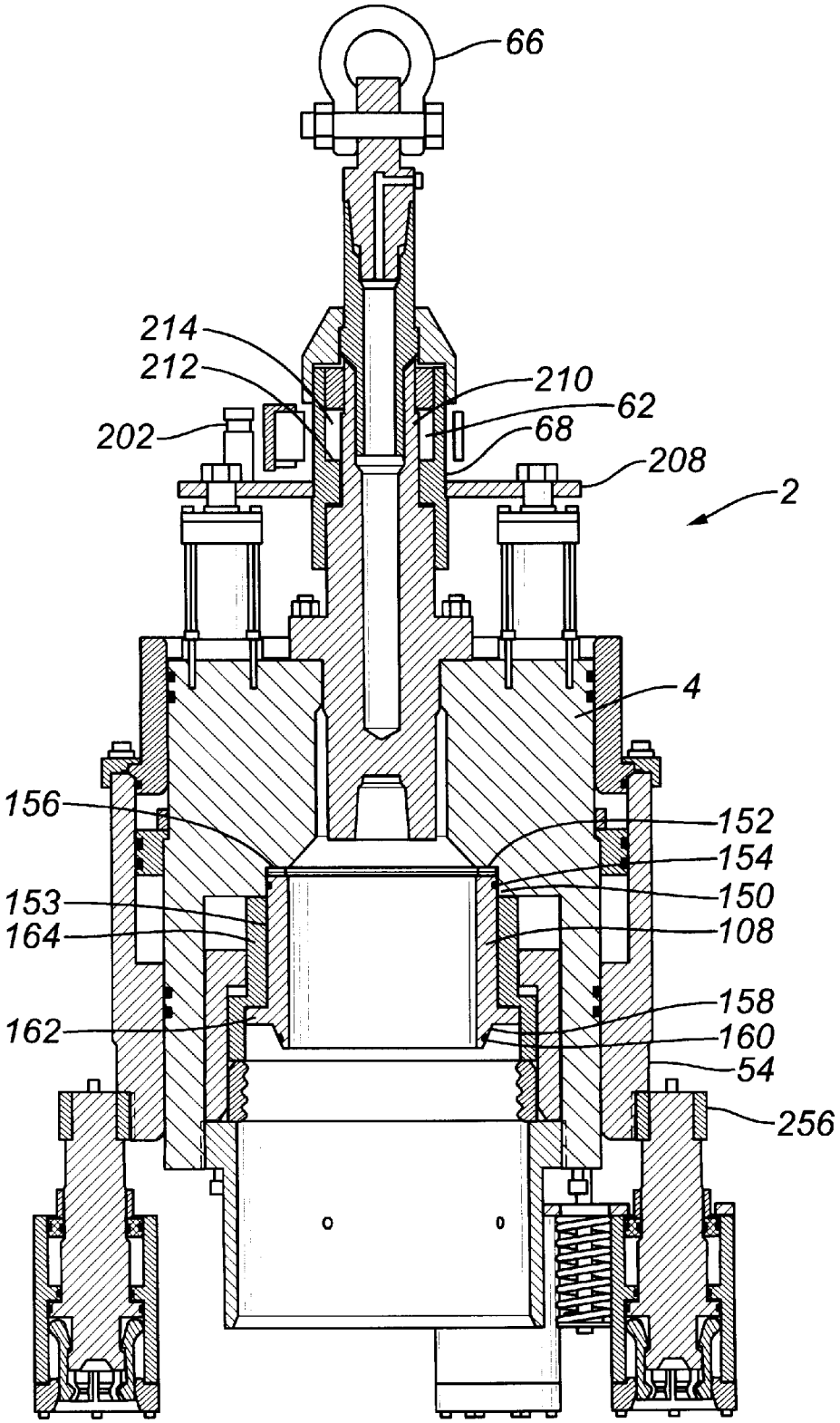
FIG. 20 is a cross sectional view of a portion of the TRT which has been enlarged to show certain details.

With reference to FIG. 20, the central body 4 of the TRT 2 includes an axial passage which is partly defined by a generally cylindrical inside surface 150 and a downwardly facing annular wall 152 extending radially inward from an upper end of the generally cylindrical inside surface 150. The piston sleeve 108 has a generally annular upper end positioned to face the annular wall 152 and a generally cylindrical outer surface 153 adjacent to its upper end positioned to face the generally cylindrical inside surface 150 of the TRT. The generally cylindrical outer surface 153 at the upper end of the piston sleeve has a circumferentially extending groove which carries a seal 154, such as an O-ring seal, to seal the annulus between the generally cylindrical outer surface at the upper end of the piston sleeve and the generally cylindrical inside surface 150 of the TRT. A biasing means 156, such as one or more Belleville springs, is positioned between the annular wall 152 and the annular upper end of the piston sleeve 108 to urge the piston sleeve downwardly, away from the annular wall 152. The lower end of the piston sleeve 108 is configured to pressure seal against the upper end of the SVT. In FIG. 20, the lower end is configured to seal against an SVT having a HX/VX gasket profile at its upper end. For this application, the floating piston sleeve is provided with a generally frustoconical outer surface 158 adjacent to its lower end which has a circumferentially extending annular groove which carries a seal 160, such as an o-ring seal, to seal against the upper end of the SVT. The seal 160 is of smaller diameter than the seal 154, which causes the seal 160 to be pressure energized against the face of the VX gasket prep when internal pressure is present inside the tool body. The Belleville springs ensure that the seal 160 remains pre-loaded and in contact with the VX prep should there be any upward movement of the tree connector due to design clearance take-up under internal pressure loads or external tensile loads. A generally annular flange 162 is preferably positioned on the outer surface of the piston sleeve 108 between the frustoconical surface 158 and the cylindrical surface 153. The annular flange has a lower face which matches the upper end of the SVT. A positioning sleeve 164 surrounds an outer periphery of the annular flange 162. The lower end of the positioning sleeve 164 has a generally cylindrical inner surface which is sized to closely receive the outer surface of the upper end of the SVT. The upper end of the positioning sleeve 164 has an inside surface which is sized to closely receive the outer surface 153 of the piston sleeve 108 and is mounted to an annular wall of the axial passage extending through the tool body, preferably at a location beneath the seal 154, such as by axially extending through bolts. The lower end of the positioning sleeve is surrounded by the internal sliding actuator sleeve 26, which is positioned between the positioning sleeve and the inside wall of the TRT central body.

TRT to SVT Latch

Figure 21:
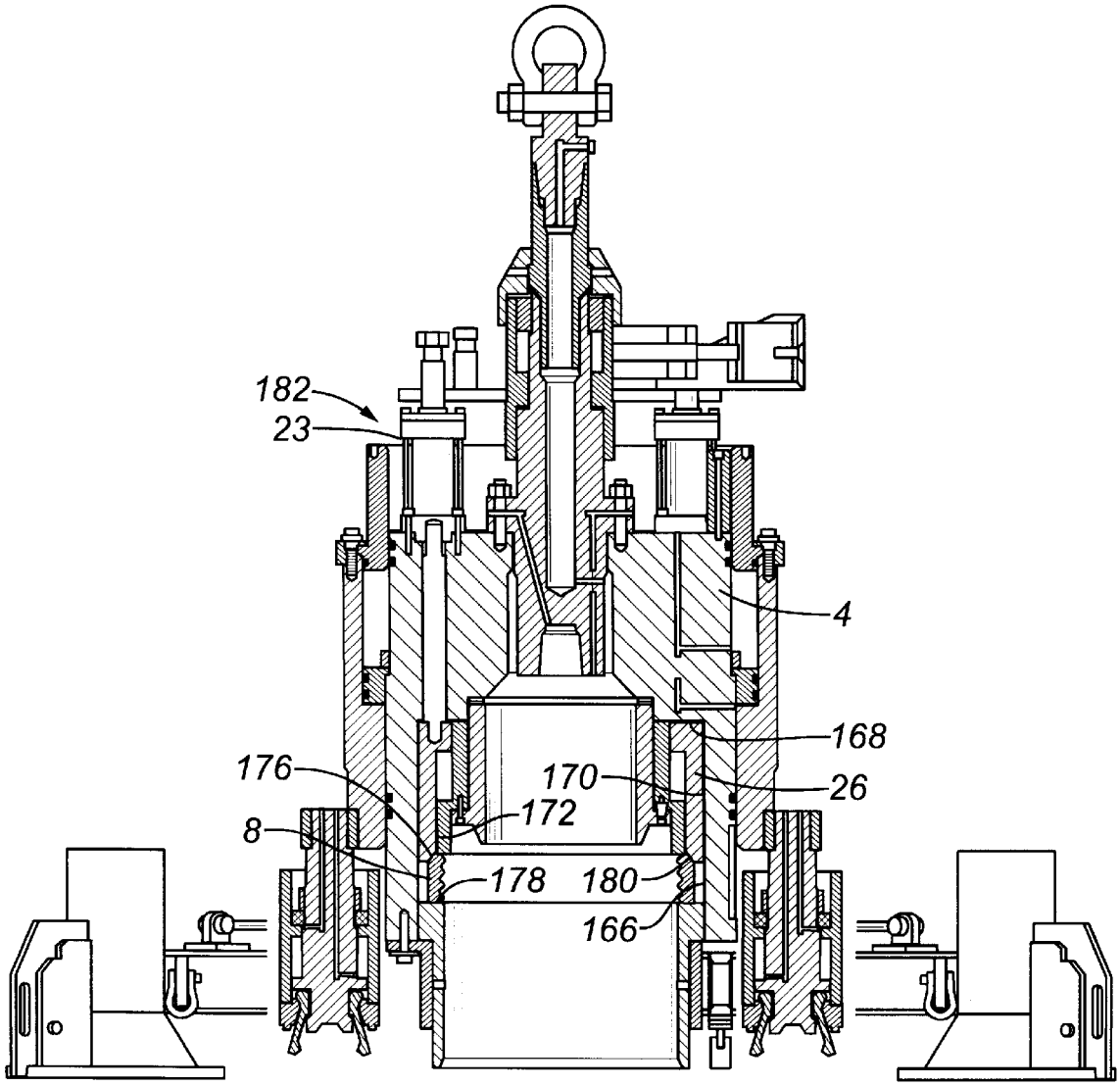
FIG. 21 is an enlarged view of the apparatus of FIG. 2 showing additional details.

With reference to FIG. 21 , the central body 4 of the TRT 2 includes an axial passage which is partly defined by a generally cylindrical inside surface 166 and an annular wall 168 extending radially inward from an upper end of the generally cylindrical inside surface 166.

The internal sliding actuator sleeve 26 has a generally cylindrical outer surface 170 which is closely received by the generally cylindrical inside surface 166, and a generally cylindrical inside surface 172 which is sized to collapse the internal split locking ring 8. The internal split locking ring 8 has a generally cylindrical outer surface 174 (see FIG. 19), and a generally frustoconical outer surface 176 positioned at its upper end. The lower end of the split locking ring is positioned against an annular shoulder 178 which extends radially inwardly near the lower end of the central body 4. The lower end of the internal sliding actuator sleeve 26 has a generally frustoconical inner surface 180 which is positioned against the generally frustoconical outer surface 176 at the upper end of the split locking ring 8, which both centers the locking ring in the central tool body and forms a lead in for collapsing the split locking ring from a first diameter to a second diameter as the sliding actuator sleeve is moved from a first position as shown in FIG. 21, for example, to a second position, as shown in FIG. 20, for example. A drive means 182 is connected to the central body and the internal actuator sleeve 26 for moving the internal actuator sleeve from the first position to the second position. When in the latched position, the actuator ring fully backs up the split ring on a vertical face to ensure no possibility of accidental unlatch under external tensile or internal pressure loads. The external latch mechanism design is not a preloaded connection. Slight clearances exist between the mating tree mandrel Vetco profile contact surfaces when fully latched. This allows the connector to be latched and unlatched with low force and facilitates emergency unlatch of the connector with low unlatch (drill pipe tension) force requirements.

Driver for the internal actuator sleeve

The drive means 182 for the internal actuator sleeve 26 is preferably formed from a plurality of hydraulic cylinders 23 mounted to the upper end of the central body 4. See FIG. 22. With reference to FIG. 23, the hydraulic cylinders 184 each comprise a tubular sidewall 186, a top end closure 190, a bottom end closure 192 and an internal piston 188 sized to be closely received by the tubular sidewall. A drive rod 194 extends from the piston 188 to the internal actuator sleeve 26. A tail rod 196 extends from the piston through the top end closure 190.

A passage 198 establishes a fluid flow path into a chamber defined between the piston and the top end closure for the supply of hydraulic fluid to drive the piston down. A passage 200 establishes a fluid flow path into a chamber defined between the piston and the bottom end closure for the supply of hydraulic fluid to drive the piston up. The provision of the tail rods, preferably of a size identical in diameter to the primary piston rods, achieves a pressure balance effect preventing accidental unlatch of the connector due to hydrostatic imbalance effects during subsea installation, operation or recovery. Rise and fall of the tail rods also serves as a visual latch/unlatch indicator when compared to a graduation mark on a rod 202 fixed to a top plate immediately adjacent one of the cylinder rods. See FIG. 20.

Mechanical TRT to SVT Unlatch Mechanism

With reference to FIG. 23, the tail rod 196 extends through a passage 204 formed in frame 70. A nut 206 is mounted on the end of the tail rod which is too large to pass through the passage. When the piston 188 is in the down position, the nut 206 is adjacent to the frame 70.

Figure 22:
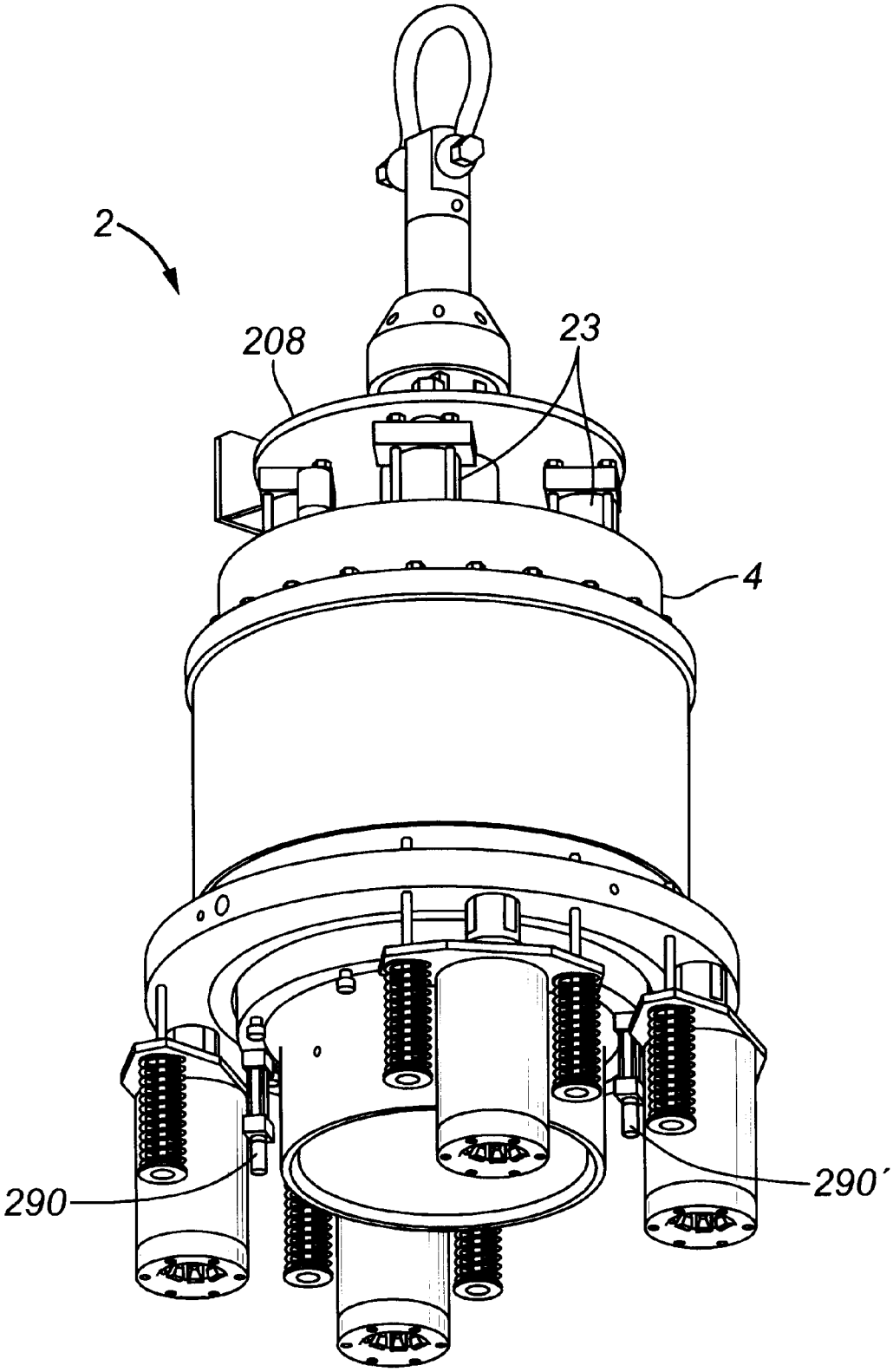
FIG. 22 is a pictorial representation of a portion of the device shown in FIG. 20.
Figure 23:
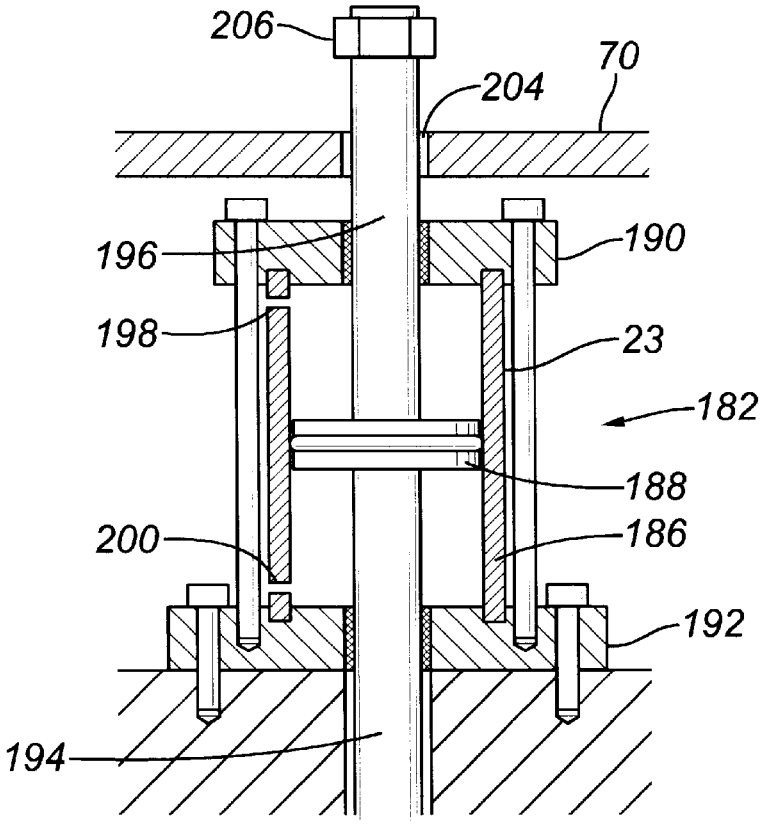
FIG. 23 is an enlarged cross sectional view of a portion of the device shown in FIG. 21 showing greater constructional details.

With reference to FIG. 22, the frame 70 is preferably formed by an annular plate 208. With reference to FIG. 20, an inner periphery of the annular plate 208 is mounted to an outer telescoping sleeve 68. An upper end of the outer telescoping sleeve is provided with a means for attachment to TRT handling equipment, such as the lifting ring 66 as shown in FIG. 20, for example, or a pipe coupling. The outer telescoping sleeve 68 is latched, via a retractable load transfer element, to an inner stem 210 having an upper end and a lower end with the lower end being attached to the central body 4. The inner stem 210 has an upwardly facing flange 212 and the outer telescoping sleeve 68 has a downwardly facing flange 214 positioned above the upwardly facing flange 212, with the load transfer element being positioned in the chamber 62 between the two flanges to space them apart when the telescoping assembly is in a collapsed configuration. Retraction of the load transfer element permits the outer telescoping sleeve to be lifted with respect to the central body 4 until the flanges contract. Lifting of the outer telescoping sleeve raises the annular plate which contacts the nuts on tail rods 196 and raises, via shafts 194 (see FIG. 23), the internal sliding actuator sleeve 26 to permit the internal split locking ring 8 to expand and disengage the SVT.

Figure 24:
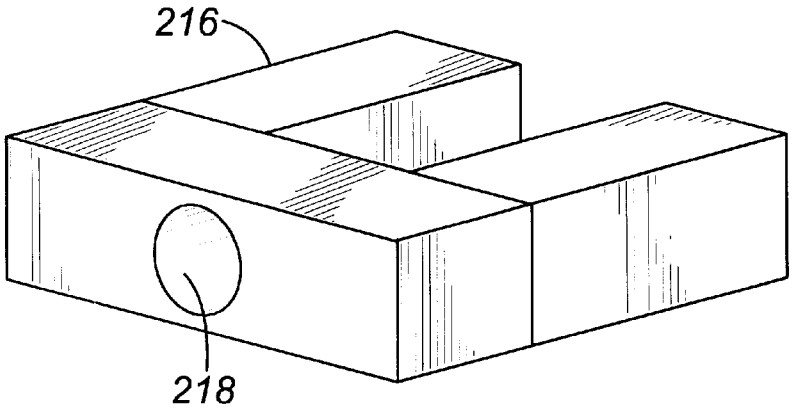
FIG. 24 is a pictorial representation of a load transfer fork which can be employed in the invention

A preferred load transfer element for positioning in the chamber 62 is in the form of a load transfer fork 216 as shown in FIG. 24. The load transfer fork 216 has a threaded borehole 218 operatively connected to the drive screw system 62 which is operatively connected to the ROV bucket 60. See also FIG. 12. Rotation of the drive screw system by an ROV torque tool attached to the ROV bucket correspondingly retracts the load transfer element.

Lockdown of Bore Protector

The SVT as shown in FIG. 3 is provided with an internal bore protector sleeve 218 to protect the bore of the SVT from tool or pipe damage and to isolate the side outlet 220 from the wellhead after installation. The bore protector is provided with an external split ring 222 near its upper end and a sliding sleeve 224 positioned to expand the ring on downward motion and cause it to lock into internal grooves at the upper end of the SVT. The internal body of the TRT is configured to push down on the sliding sleeve under the weight of the TRT when the TRT is placed on the SVT with bore protector to lock the bore protector into the SVT.

Orientation of TRT to SVT

In certain situations, such as might be the case during surface operations, testing procedures, or predeployment, the guide posts to provide proper orientation of the TRT to the SVT may not be available. The TRT is provided with an orientation pin 20 extending from the central body 4 to engage with a hole 22 at the upper end of the SVT. With reference to FIG. 11, the orientation pin 20 preferably extends axially downwardly from the generally annular flange 162 on the outer surface of the piston sleeve 108. The hole 22 preferably opens onto the face at the upper end of the SVT which is contacted by the annular flange 162. The hole 22 is positioned and sized to receive the orientation pin 20. The orientation pin 20 is preferably spring loaded to depress flush with the face of the annular flange when the annular flange contacts the upper end of the SVT and extend into the hole by action of the spring when the TRT and SVT are oriented to bring the orientation pin and the hole into axial alignment.

Porting arrangements

With reference to FIG. 3, the inner stem 210 is provided with a port 226 to provide for pressuization/bleed-down of the SVT body to a drill pipe running string. The lower end of the inner stem 210 is provided with a drill pipe box connection 228. This feature is provided that it is ever deemed necessary or desirable to run a cup tester on the bottom of the TRT for the purpose of isolating the production casing to internally pressure the SVT after installation. The inner stem 210 also is provided with two additional hydraulic ports 230, 232 ported radially through an upper connecting flange of the stem which may be used for pressurization and bleed down of the SVT. The porting arrangement is configured to allow for multiple testing scenarios with or without a cup tester.

Make-up Connection

With reference to FIG. 4, a union nut drill pipe make-up connection 234 is mounted to the upper end of the inner stem 210, to provide for drill string makeup on the ring floor and facilitate manual make-up of the drill pipe running string in the moon pool by rig personnel. The connection 234 includes a union nut 236 with lockdown set screws 238, 240 to prevent accidental unthreading of the nut connection from the inner stem. A handling and test sub 242 is mounted to the upper end of the make-up connection 234, and includes the lift ring 66 at the upper end. The sub seals to the make-up connection 234 immediately below box threads 244 and a port 246 extends through the sub body from the lower end to a side outlet to facilitate pressure testing of the TRT or SVT. The sub is preferably removed prior to using the TRT for actual installation or recovery of the SVT.

SVT to Wellhead Connector Actuation System

With reference to FIG. 8, an SVT-to-wellhead connector actuation system 250 is mounted on the outside of the TRT. The actuation system is designed to interface with the SVT mechanical tree-to-wellhead connector for purposes of locking and unlocking the SVT to and from the wellhead. The SVT is provided with a reciprocal connection system 252 for connecting with the SVT mechanical tree-to-wellhead connector to actuation system 250 mounted to the outside of the TRT.

The action system 250 comprises an axially movable hydraulic piston carried by the central body 4 which is mechanically fixedly connected to a connector unit for coupling to the connection system 252 of the SVT. A preferred axially movable hydraulic piston is annular in cross section and is shown in the form of the external sliding actuator sleeve 54.

With reference to FIG. 6, the central body 4 is provided with an annular flange 251. The sliding actuator sleeve 54 is provided with an annular groove 253 on its inner surface and the annular flange on the central body is positioned in the annular groove, defining an upper hydraulic chamber 255 between the annular flange 251 and an upper annular face of the groove and a lower hydraulic chamber 257 between the annular flange and a lower annular face of the groove. A hydraulic passage 259 communicates with the upper hydraulic chamber and a hydraulic passage 261 communicates with the lower hydraulic chamber. The chambers are sized to properly preload the SVT to wellhead connector.

Preferably a plurality of connector units 254 are fixedly connected to the movable hydraulic piston, and each connector unit is actuatable for selectively connecting to or disconnecting from the connection system 252 on the SVT. More preferably, each of the connector units comprises a shaft having an upper end and a lower end, with the upper end being connected to the sliding actuator sleeve and the lower end having a gripper for connecting to a portion of the connection system 252 on the SVT.

Figure 25:
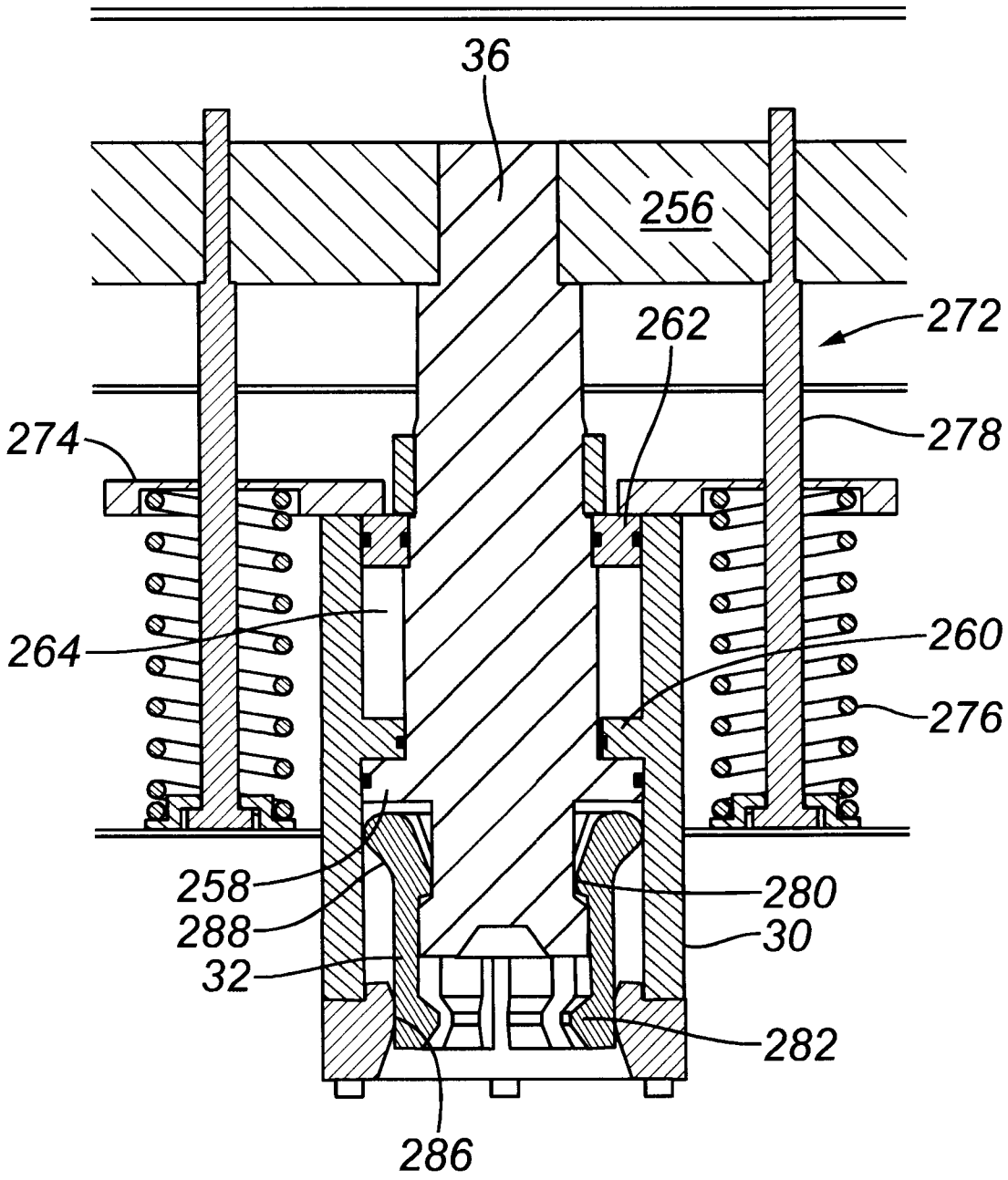
FIG. 25 is an enlarged cross sectional view of a portion of the device shown in FIG. 22.

As shown in FIG. 20, a flange 256 extends radially outwardly from a lower end of the external sliding acuator sleeve 54. The shaft 36 has an upper end and a lower end, with the upper end fixed to the flange 256. With reference to FIG. 25, a tubular housing 30 surrounds the shaft 36. The shaft 36 has a radially outwardly extending annular flange 258 on its midsection which is sized to closely fit an inside surface of the tubular housing 30. The tubular housing 30 has an inwardly extending annular flange 260 in its midsection which is sized to closely encompass the shaft 30. The annular flange 260 is positioned above the annular flange 258. A seal 262 positioned at the upper end of the housing seals the annulus between the shaft 36 and the housing 30. An upper annular hydraulic chamber 264 is defined between the flange 260 and the seal 262.

With reference to FIG. 3, a lower annular hydraulic chamber 266 is defined between the flange 260 and the flange 258. A hydraulic fluid passage 268 establishes a fluid flow path into the upper chamber 264. A hydraulic fluid passage 270 establishes a fluid flow path into the lower chamber 266. In the illustrated embodiment, the passages are formed in the shaft 36.

With reference to FIG. 25, a means 272 is provided for biasing the housing 30 toward the flange 256. The means 272 comprises a plate 274 mounted to the upper end of the housing 30 and defining ears having apertures therethrough and springs 276 for biasing the plate 274 toward the flange 256. Shafts 278 extend from the flange 256 and through the apertures. The shafts 278 have spring retainers at their lower end, the upper end being fixed to the flange 256. The springs 276 are positioned around the shafts 278 and contact the plate 274 and the spring retainers to bias the plate 274 toward the flange.

A plurality of collet fingers 32 are positioned at the lower end of the shaft 36. The collet fingers are peripherally mounted to the end of the shaft. Each collet finger is provided with a radially inwardly extending upper hook 280 near its upper end, and a radially inwardly extending lower hook 282 near its lower end. The upper hook rests in an annular groove near the lower end of the shaft 36 to secure the hook against longitudinal movement with respect to the shaft 36. The lower hook is spaced apart from the lower end of the shaft 36 and is contoured to latch to an annular groove 284 near the upper end of connector posts 28 of the SVT. See FIG. 5.

Referring again to FIG. 25, an annular flange 286 extends radially inwardly at the lower end of the housing 30. Each collet finger 32 is provided with a radially outwardly extending downwardly facing tapered shoulder 288 adjacent to its upper end, and a relief taper radially inward across from the shoulder 288. Retraction of the housing 30 urges the flange 286 against the shoulders 288 to swing the lower ends of the collet fingers radially outwardly. Extension of the housing 30 moves the flange against cylindrically shaped outer surfaces of the collet fingers to close them.

The housing 30 is extended to latch the collet fingers to the upper end of connector posts 28. The lower end of connectors posts 28 are attached to a frame 290 (See FIG. 5) which is peripherally longitudinally movably mounted to the outside of the SVT. The frame 290 is mounted to the internal sliding actuator sleeve 50 (see FIG. 9). As the SVT lands on the upper end of the wellhead, the ridges on the locking ring 42 align radially outward from the grooves at the upper end of the wellhead 40. Fluid pressure to port 48 is then supplied to move the external sliding actuator sleeve 54 in the fully extended down position, as indicated by arrows 49, pushing down on connectors posts 28 thereby urging the internal sliding actuator sleeve 50 alongside the split locking ring 42 to collapse the ridges on the ring into the grooves on the wellhead and lock the SVT to the wellhead. Fluid pressure is then supplied to port 52 to move the collet latch housings 30 to the unlatched position and release collet fingers 32 from connector posts 28.

The gripper units are basically hydraulic collet-type connectors designed to latch and unlatch to four corresponding vertical push-pull columns which are fixed to the mechanical tree connector actuation ring assembly. The gripper units transfer compressive lock and tensile unlock forces between the outer annular hydraulic actuation piston and the tree connector push-pull columns. Latch and unlatch of the gripper units is accomplished by means of a hydraulic annular piston arrangement integral with each gripper unit; this provides the capability to hydraulically latch and unlatch the gripper units, even though there is a spring return fail-safe unlatch feature which is a backup to the hydraulic unlatch mode in the event emergency unlatch is required. When unlatched, the collet fingers of the gripper unit are cammed opened by the annular piston actuation sleeve, providing a generous lead-in (and clearance) funneling effect when engaging/disengaging the tree connector push-pull columns. This ensures precise alignment of the gripper with the corresponding push-pull column by the aligning action of one vertical conical surface on another. When latched to the push-pull columns, the gripper collet fingers are fully backed up by a vertical face on the actuation sleeve. Thus, there are no vertical reaction loads trying to unlatch the griper from the column when tensile separating loads are applied. This is a non-preloaded connection as there is actually a slight clearance between the mating collet finger contact face and the push-pull column engagement hub face. The gripper units also include an emergency unlatch feature. This takes the form of fail-safe spring return unlatch system. Dual springs mounted outboard and parallel to the gripper assembly react between the gripper actuator sleeve and the fixed gripper mounting surface providing automatic unlatch of the gripper when the latch and unlatch hydraulic control functions are vented. This of course requires that latch pressure be maintained during tree deployment in order to remain engaged with the tree connector push-pull columns. The hydraulic unlatch feature can be used in lieu of the spring return unlatch system or if it is necessary to provide additional unlatch force.

Secondary SVT to wellhead lockdown

With reference to FIG. 22, a pair of small hydraulic cylinders 290, 290' extend vertically downward from the lower end of the central body 4 of the TRT. These cylinders are designed to depress rod extensions 292 extending from SVT mechanical tree connector secondary lockdown assemblies 294 operatively connected to internal sliding actuator sleeve 50 in the SVT. See FIG. 3. Depressing the rod extensions serves to release slips in the secondary lockdown assemblies allowing tree connector function (lock/unlock) without shearing the emergency release shear sleeves in each unit.

Visual position indicators

Figure 6A:
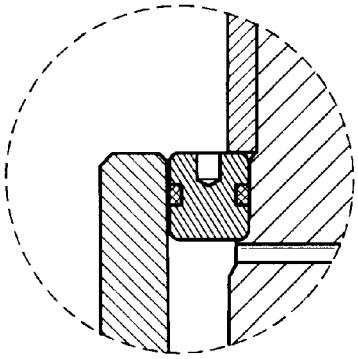
FIGS. 6A and 6B show portions of the device of FIG. 6 in greater detail.
Figure 6B:
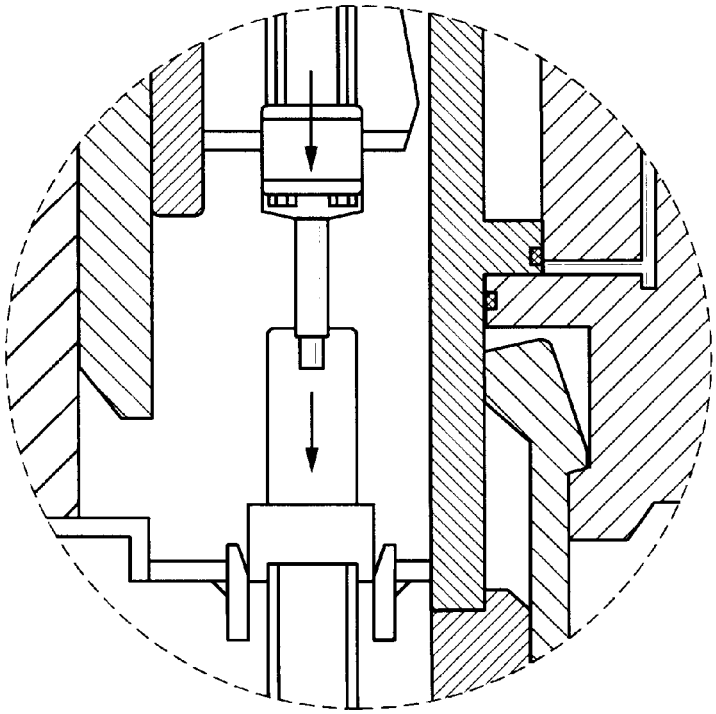

With reference to FIG. 6, the position of the sliding actuator sleeve 54 is visually checked against marks provided in location 296 at the upper end of the central body 4 to determine whether the connector units are in the retracted or engaged position, and whether the SVT to wellhead connector is latched or unlatched. With reference to FIG. 6A, the position of the collet latch housings 30 is visually checked against the seals carried by the shafts 36 to determine whether the grippers are latched or unlatched. With reference to FIG. 2, the position of the tail rods 206 is visually checked against an indicator mark 298 carried by a vertical shaft on the upper end of the TRT to determine whether the TRT is latched or unlatched to the SVT.

TRT guide frame

The TRT guide frame is a typical four-funnel system designed to guide the TRT onto or off of the SVT with the aid of guidewires and corresponding SVT guide posts. The top of the guide frame is covered with grating which serves as a safe working platform for rig personnel when making up the drill pipe running connection or the installation control umbilical. An access ladder, which is in alignment with a corresponding tree access ladder) is also provided to facilitate access to the TRT work surface during tree deployment or recovery. A vertically mounted workover umbilical hydraulic junction plate is mounted to the framework and routes hydraulic control functions to the TRT and SVT related ROV flying lead hydraulic control function. The TRT connector latch/unlatch and column gripper latch/unlatch function control tubing is routed in such a manner as to facilitate ROV cutting (local venting) in the event of emergency unlatch due to a control umbilical catastrophic failure. The ROV flying lead hydraulic control functions are attached to a special ROV deployed hydraulic junction plate which can be plugged into the SVT to obtain control of certain tree functions. When not attached to the SVT, the ROV junction plate is parked on a TRT-mounted parking and test receptacle junction plate. Guide frame funnels are designed to accept the full weight of the tree running when sat down in a free-standing mode. Sea fastening provisions are provided as part of the guide funnel design.

Additional Detailed Description

In accordance with certain preferred aspects of the present invention, there is provided tree running tool 2 with a mechanical mechanism for unlatching the tree running tool from a side valve tree. The tree running tool is formed from a tool body 4, a stem 210, a telescoping element 68, a retractable spacer 62, a means 60 for moving the spacer, and a means 66 for attaching the telescoping element to a lift device.

The tool body has an upper end, a lower end, and a longitudinal axis.

The stem is fixedly attached to the upper end of the tool body and extends axially therefrom. The stem has a lower end attached to the tool body and a generally annular flange at a position spaced apart from the tool body.

The telescoping element is positioned alongside the stem. The telescoping element has a generally annular flange at a position between the generally annular flange of the stem and the tool body.

The retractable spacer is movable from an engaged position between the generally annular flange of the stem and the generally annular flange of the telescoping element, in which the spacer spaces the generally annular flange of the stem apart from the generally annular flange of the telescoping element, to a retracted position in which a void is formed between the generally annular flange of the stem and the generally annular flange of the sleeve.

The means for moving the spacer is mounted to the tool body and the spacer for moving the spacer from the engaged position to the retracted position.

The means for attaching the telescoping element to a lift device is mounted to the telescoping element.

Preferably, the spacer is generally U-shaped and is formed by a pair of parallel load transfer legs and a connecting leg. The connecting leg has a threaded passage therethrough. The means for moving the spacer from the engaged position to a retracted position comprises a shaft having a head portion and a threaded portion. The threaded portion of the shaft engages the threaded passage extending through the connecting leg and the shaft extends generally normally to the longitudinal axis of the tool body. A frame is fixedly connected to the upper end of the tool body and has a passage therethrough which receives the shaft. The head portion of the shaft is too large to pass through the passage in the frame, so that rotation of the shaft retracts the spacer toward the frame to form the void between the flanges.

The telescoping element preferably forms a sleeve which surrounds the stem. The flange of the telescoping element preferably extends radially inward from an inner surface of the sleeve, and the flange on the stem extends preferably extends radially outward from an outer surface of the stem. The telescoping element is fixed in a first position when the spacer is in the engaged position and is movable to a second position wherein the flange of the telescoping element contacts the flange of the stem when the spacer is in the retracted position.

The device further preferably comprises a latch means for latching the tree running tool to a side valve tree, The latch means is mounted near the lower end of the tool body. Preferably, the latch means includes an axially movable actuating element 26 which moves from an upper disengaged position to a lower engaged position. A means for connecting the telescoping element to the actuating element is preferably provided so that movement of the telescoping element from the first position to the second position moves the actuating element from the lower engaged position to the upper disengaged position.

The means for connecting the telescoping element to the actuating element preferably comprises a frame means 70 and a shaft means 72. The frame means extends radially outward from the sleeve and has an axial passage therethrough at a position radially spaced apart from the sleeve. The shaft means preferably extends slidably though the passage. The shaft means is preferably axially positioned and has a fitting positioned above the frame means which is too large to pass through the passage. The lower end of the shaft means is connected to the actuating element 26. Movement of the telescoping element from the first position toward the second position raises the frame means to contact the fitting on the shaft means and further movement of the telescoping element raises the shaft means to raise the actuating element.

The frame means is preferably formed by an annular flange 208 attached to the sleeve and extending radially outwardly from the sleeve. The annular flange has an aperture therethrough forming the passage. The fitting on the shaft means preferably comprises a nut.

Preferably, the shaft means comprises a piston 188 having an upper connecting shaft 196 which passes through the aperture and a lower connecting shaft 194 which is connected to the actuating element. The tree running tool preferably further comprises a means defining a hydraulic chamber mounted to the tool body. The piston is preferably positioned in said means defining the hydraulic chamber to divide the hydraulic chamber into an upper chamber and a lower chamber. A supply of hydraulic fluid to the upper chamber lowers the piston and supply of fluid to the lower chamber raises the piston.

In another aspect of the preferred embodiment of the invention, there is provided a method for mechanically unlatching a tree running tool from a side valve tree. The tree running tool comprises a tool body, a latch means, a hydraulic unit, and a shaft.

The tool body has an upper end, a lower end, and a longitudinal axis.

The latch means for latching the tree running tool to the side valve tree is mounted near the lower end of the tool body. The latch means includes an axially movable actuating element which moves from an upper disengaged position to a lower engaged position.

The hydraulic unit is mounted to the upper end of the tool body.

The shaft extends downwardly from the hydraulic unit for connecting the hydraulic unit to the actuating element.

The hydraulic unit is operable for moving the shaft up and down to move the actuating element between the upper disengaged position and the lower engaged position.

The method is carried out by providing a shaft extending upwardly from the hydraulic unit. The upwardly extending shaft is connected by a portion of the hydraulic unit to the downwardly extending shaft so that lifing upward on the upwardly extending shaft moves the downwardly extending shaft upward. By lifing upward on the upwardly extending shaft the latch means is moved to the disengaged position.

In a preferred embodiment, an upper hydraulic chamber of the hydraulic unit is unsealed prior to lifting upwardly on the upwardly extending shaft.

The tree running tool preferably further comprises a stem, a telescoping element, and means for connecting the telescoping element to the actuating element.

The stem is fixedly attached to the upper end of the tool body and extends axially from the upper end of the tool body. The stem has a lower end attached to the tool body and a generally annular flange at a position spaced apart from the tool body.

The telescoping element is preferably positioned alongside the stem. The telescoping element has a generally annular flange at a position between the generally annular flange of the stem and the tool body. The telescoping element is movable from a first position wherein the flange of the telescoping element is spaced apart from the flange on the stem to a second position wherein the flange of the telescoping element contacts the flange on the stem.

The means for connecting the telescoping element to the actuating element is provided so that movement of the telescoping element from the first position to the second position moves the actuating element from the lower engaged position to the upper disengaged position.

In this embodiment, the method preferably further comprises moving the telescoping element from the first position to the second position.

In a further preferred embodiment, the telescoping element is attached to a lift device; and moved from the first position to the second position with the lift device.

While certain preferred embodiments of the invention have been described herein, the invention is not to be construed as being so limited, except to the extent that such limitations are found in the claims.

What is claimed is:

1. A tree running tool with a mechanical mechanism for unlatching the tree running tool from a side valve tree, said tree running tool comprising a tool body having an upper end, a lower end, and a longitudinal axis;

a stem fixedly attached to the upper end of the tool body and extending axially therefrom, said stem having a lower end attached to the tool body and a generally annular flange at a position spaced apart from the tool body;

a telescoping element positioned alongside the stem, said telescoping element having a generally annular flange at a position between the generally annular flange of the stem and the tool body;

a retractable spacer movable from an engaged position between the generally annular flange of the stem and the generally annular flange of the telescoping element, wherein the spacer spaces the generally annular flange of the stem apart from the generally annular flange of the telescoping element, to a retracted position in which a void is formed between the generally annular flange of the stem and the generally annular flange of the telescoping element;

a means mounted to the tool body and the spacer for moving the spacer from the engaged position to the retracted position; and a means mounted to the telescoping element for attaching the telescoping element to a lift device.

2. A tree running tool as in claim 1 wherein the spacer is generally U-shaped and is formed by a pair of parallel load transfer legs and a connecting leg, wherein the connecting leg has a threaded passage therethrough, and the means for moving the spacer from the engaged position to the retracted position comprises a shaft having a head portion and a threaded portion, the threaded portion of the shaft engaging the threaded passage extending through the connecting leg, said shaft extending generally normally to the longitudinal axis of the tool body, and a frame fixedly connected to the upper end of the tool body and having a passage therethrough which receives the shaft, the head portion of the shaft being too large to pass through the passage in the frame, whereby rotation of the shaft retracts the spacer toward the frame to form the void between the flanges.

3. A tree running tool as in claim 2 wherein the telescoping element forms a sleeve which surrounds the stem, the flange of the telescoping elements extending radially inward from an inner surface of the sleeve, and the flange on the stem extends radially outward from an outer surface of the stem, wherein the telescoping element is fixed in a first position when the spacer is in the engaged position and is movable to a second position wherein the flange of the telescoping element contacts the flange of the stem when the spacer is in the retracted position.

4. A tree running tool as in claim 3 further comprising a latch means for latching the tree running tool to a side valve tree mounted near the lower end of the tool body, said latch means including an axially movable actuating element which moves from an upper disengaged position to a lower engaged position, and means for connecting the telescoping element to the actuating element so that movement of the telescoping element from the first position to the second position moves the actuating element from the lower engaged position to the upper disengaged position.

5. A tree running tool as in claim 4 wherein the means for connecting the telescoping element to the actuating element comprises a frame means extending radially outward from the sleeve, said frame means having an axially passage therethrough at a position radially spaced apart from the sleeve, and shaft means extending slidably through the passage, said shaft being axially positioned and having a fitting on the shaft means positioned above the frame means which is too large to pass through the passage, the lower end of the shaft means being connected to the actuating element;

wherein the movement of the telescoping element from the first position toward the second position raises the frame means to contact the fitting on the shaft means and further movement of the telescoping element raises the shaft means to raise the actuating element.

6. A tree running tool as in claim 5 wherein the frame means is formed by an annular flange attached to the sleeve and extending radially outwardly therefrom, said annular flange having an aperture therethrough forming the passage and the fitting on the shaft means comprises a nut.

7. A tree running tool as in claim 5 wherein the shaft means comprises a piston having an upper connecting shaft which passes through the aperture and a lower connecting shaft which is connected to the actuating element, wherein said tree running tool further comprises means defining a hydraulic chamber mounted to the tool body, wherein said piston is positioned in said means defining the hydraulic chamber to divide the hydraulic chamber into an upper chamber and a lower chamber;

wherein supply of hydraulic fluid to the upper chamber lowers the piston and supply of fluid to the lower chamber raises the piston.

8. A method for mechanically unlatching a tree running tool from a side valve tree, wherein the tree running tool comprises a tool body having an upper end, a lower end, and a longitudinal axis;

a latch means for latching the tree running tool to a side valve tree mounted near the lower end of the tool body, said latch means including an axially movable actuating element which moves from an upper disengaged position to a lower engaged position, and a hydraulic unit mounted to the upper end of the tool body;

a shaft extending downwardly from the hydraulic unit for connecting the hydraulic unit to the actuating element;

said hydraulic unit being operable for moving the shaft up and down to move the actuating element between the upper disengaged position and the lower engaged position;

said method comprising providing a shaft extending upwardly from the hydraulic unit, said upwardly extending shaft being connected by a portion of the hydraulic unit to the downwardly extending shaft so that lifting upward on the upwardly extending shaft moves the downwardly extending shaft upward; and lifing upward on the upwardly extending shaft to move the latch means to the disengaged position.

9. A method as in claim 8 further comprising unsealing an upper hydraulic chamber of the hydraulic unit prior to lifting upwardly on the upwardly extending shaft.

10. A method as in claim 9 wherein the tree running tool further comprises a stem fixedly attached to the upper end of the tool body and extending axially therefrom, said stem having a lower end attached to the tool body and a generally annular flange at a position spaced apart from the tool body;

a telescoping element positioned alongside the stem, said telescoping element having a generally annular flange at a position between the generally annular flange of the stem and the tool body, said telescoping element being movable from a first position wherein the flange of the telescoping element is spaced apart from the flange on the stem to a second position wherein the flange of the telescoping element contacts the flange on the stem;

means for connecting the telescoping element to the actuating element so that movement of the telescoping element from the first position to the second position moves the actuating element from the lower engaged position to the upper disengaged position;

said method further comprising moving the telescoping element from the first position to the second position.

11. A method as in claim 10 further comprising attaching the telescoping element to a lift device; and moving the telescoping element from the first position to the second position with the lift device.

12. A method for mechanically unlatching a tree running tool from a side valve tree, wherein the tree running tool comprises a tool body having an upper end, a lower end, and a longitudinal axis;

a latch means for latching the tree running tool to a side valve tree mounted near the lower end of the tool body, said latch means including an axially movable actuating element which moves from an upper disengaged position to a lower engaged position;

a hydraulic unit mounted to the upper end of the tool body;

a shaft extending downwardly from the hydraulic unit for connecting the hydraulic unit to the actuating element; and said hydraulic unit being operable for moving the shaft up and down to move the actuating element between the upper disengaged position and the lower engaged position;

said method comprising providing a shaft extending upwardly from the hydraulic unit, said upwardly extending shaft being connected by a portion of the hydraulic unit to the downwardly extending shaft so that lifting upward on the upwardly extending shaft moves the downwardly shaft upward;

unsealing an upper hydraulic chamber of the hydraulic unit prior to lifting upwardly on the upwardly extending shaft; and lifting upward on the upwardly extending shaft to move the latch means to the disengaged position.

13. A method as in claim 12 wherein the tree running tool further comprises a stem fixedly attached to the upper end of the tool body and extending axially therefrom, said stem having a lower end attached to the tool body and a generally annular flange at a position spaced apart from the tool body;

a telescoping element positioned alongside the stem, said telescoping element having a generally annular flange at position between the generally annular flange of the stem and the tool body, said telescoping element being movable from a first position wherein the flange of the telescoping element is spaced apart from the flange on the stem to a second position wherein the flange of the telescoping element contacts the flange on the stem;

means for connecting the telescoping element to the actuating element so that movement of the telescoping element from the first position to the second position moves the actuating element from the lower engaged position to the upper disengaged position;

said method further comprising moving the telescoping element from the first position to the second position.

14. A method as in claim 13 further comprising attaching the telescoping element to a lift device; and moving the telescoping element from the first position to the second position with the lift device.

* * * * *